US008925680B2

(12) United States Patent
Herrli

(10) Patent No.: US 8,925,680 B2
(45) Date of Patent: Jan. 6, 2015

(54) RAPPELLING APPARATUS AND METHOD

(76) Inventor: Brian Christopher Herrli, Chicago, IL (US)

( * ) Notice: Subject to any disclaimer, the term of this patent is extended or adjusted under 35 U.S.C. 154(b) by 129 days.

(21) Appl. No.: 13/183,137

(22) Filed: Jul. 14, 2011

(65) Prior Publication Data

US 2012/0012422 A1 Jan. 19, 2012

Related U.S. Application Data

(60) Provisional application No. 61/364,291, filed on Jul. 14, 2010.

(51) Int. Cl.
*A62B 1/14* (2006.01)

(52) U.S. Cl.
CPC ..... *A62B 1/14* (2013.01)
USPC ..... 182/5; 188/65.4; 182/192

(58) Field of Classification Search
USPC ..... 182/5, 191–193, 3, 6, 7, 70, 72; 188/65.4, 65.1; 24/134 R, 134 KB, 24/134 KA, 133
See application file for complete search history.

(56) References Cited

U.S. PATENT DOCUMENTS 194,507 A * 8/1877 Van Wie ..... 188/65.4
213,165 A * 3/1879 Brice ..... 188/65.1
469,239 A * 2/1892 Gardner ..... 188/65.4
505,706 A * 9/1893 Fowler ..... 182/191
553,190 A * 1/1896 Fowler ..... 182/191
556,099 A * 3/1896 Kingsbury ..... 188/65.5
678,533 A * 7/1901 Bancker ..... 24/129 B
678,866 A * 7/1901 Duvall ..... 24/115 R
688,592 A * 12/1901 Chadwick ..... 182/6
785,202 A * 3/1905 Dahlquist ..... 188/65.3
950,702 A * 3/1910 O'Brien ..... 24/133
1,114,392 A * 10/1914 Shuart ..... 182/193
1,852,887 A * 4/1932 Lossius ..... 182/191
2,309,971 A * 2/1943 McLarn ..... 174/158 R
2,585,876 A * 2/1952 Thoennes ..... 182/236
2,845,674 A * 8/1958 Pearson ..... 24/134 KB
3,022,856 A * 2/1962 Galeano ..... 182/193
3,217,840 A * 11/1965 Holkesvick ..... 188/65.4
3,235,031 A * 2/1966 Cenker ..... 182/5

(Continued)

OTHER PUBLICATIONS

Emergency Escape and Self Rescue Ropes and System Components for Firefighters; New York Codes, Rules and Regulations, 12NYCRR Section 800.7; Jun. 6, 2008; 8 pages; Albany, New York, USA.

(Continued)

*Primary Examiner* — Daniel Cahn
(74) *Attorney, Agent, or Firm* — Reinhart Boerner Van Deuren P.C.

(57) ABSTRACT

A rappelling apparatus and method are provided, for controlling the rate of movement of a person along a safety line away from an anchored end of the safety line, through use of a control bar having an attachment at one end thereof for a harness safety belt, or the like connected to the person, an operating handle at an opposite end thereof, and provisions between the opposite ends of the control bar for passage of the safety line through the control bar in serpentine pattern. The operating handle is pivoted away from the safety line to reduce the severity of the serpentine pattern and allow controlled movement of the safety line through the control bar. Some forms of the control bar include a one-way clutching arrangement. Some forms of the control bar also include a hand-actuated braking arrangement.

8 Claims, 32 Drawing Sheets

(56) References Cited

U.S. PATENT DOCUMENTS

| | | | | | |
|---|---|---|---|---|---|
| 3,260,328 | A | * | 7/1966 | McGowan | 182/5 |
| 3,340,964 | A | * | 9/1967 | Glover | 188/65.4 |
| 3,695,397 | A | * | 10/1972 | Hobbs | 188/65.4 |
| 3,717,219 | A | * | 2/1973 | Hoffman | 182/6 |
| 3,757,893 | A | * | 9/1973 | Hobbs | 182/6 |
| 3,757,901 | A | * | 9/1973 | Hobbs | 188/65.4 |
| 4,092,075 | A | * | 5/1978 | Kimball | 403/72 |
| 4,226,305 | A | * | 10/1980 | Frestad | 188/65.2 |
| 4,311,217 | A | * | 1/1982 | Wood | 188/65.2 |
| 4,311,218 | A | * | 1/1982 | Steffen | 188/65.4 |
| 4,372,422 | A | * | 2/1983 | Sharp | 182/5 |
| 4,394,992 | A | * | 7/1983 | Fohl | 242/396.5 |
| 4,428,455 | A | * | 1/1984 | Dale | 182/7 |
| 4,508,193 | A | * | 4/1985 | Forrest | 182/5 |
| 4,580,658 | A | * | 4/1986 | Brda | 182/5 |
| 4,596,314 | A | * | 6/1986 | Rogelja | 188/65.5 |
| 4,678,059 | A | * | 7/1987 | Bowker | 182/5 |
| 4,679,654 | A | * | 7/1987 | Lu | 182/5 |
| 4,714,135 | A | * | 12/1987 | Bell et al. | 182/6 |
| 4,723,634 | A | * | 2/1988 | Fisk | 188/65.4 |
| 4,941,434 | A | * | 7/1990 | Ellwanger | 119/771 |
| 5,054,577 | A | * | 10/1991 | Petzl et al. | 182/5 |
| 5,107,956 | A | * | 4/1992 | Constantinis et al. | 182/5 |
| 5,131,491 | A | * | 7/1992 | Varner et al. | 182/7 |
| 5,145,036 | A | * | 9/1992 | Omalia | 188/65.5 |
| 5,295,559 | A | * | 3/1994 | Nutkins | 188/65.4 |
| 5,379,858 | A | * | 1/1995 | Sandoval | 182/7 |
| 5,511,291 | A | * | 4/1996 | Crawford | 24/129 R |
| 5,850,893 | A | * | 12/1998 | Hede et al. | 182/193 |
| 6,062,340 | A | * | 5/2000 | Walker | 182/5 |
| 6,095,282 | A | * | 8/2000 | Sadeck | 182/6 |
| 6,131,697 | A | | 10/2000 | Basset | |
| 6,317,935 | B1 | * | 11/2001 | O'Rouke | 24/129 R |
| 6,568,511 | B1 | * | 5/2003 | Day | 188/65.4 |
| 6,814,185 | B1 | | 11/2004 | Ostrobrod | |
| 6,948,586 | B1 | * | 9/2005 | Saucedo | 182/5 |
| 6,959,783 | B2 | * | 11/2005 | Kwak et al. | 182/5 |
| 6,962,238 | B1 | * | 11/2005 | Ostrobrod | 182/193 |
| 7,137,481 | B2 | | 11/2006 | Petzl et al. | |
| 7,757,812 | B2 | * | 7/2010 | Bamberg et al. | 182/5 |
| 7,866,634 | B2 | * | 1/2011 | Lipke | 254/389 |
| 8,321,998 | B2 | * | 12/2012 | Warren | 24/134 KA |
| 8,376,081 | B2 | * | 2/2013 | Schwarzenbach et al. | 182/5 |
| 2011/0011672 | A1 | * | 1/2011 | Price, Jr. | 182/5 |
| 2011/0315480 | A1 | * | 12/2011 | Maurice et al. | 182/193 |

OTHER PUBLICATIONS

Fire Rescue; Sterling Rope Company, Inc. Catalog; date last visited Jun. 24, 2010; 1 page printed from internet; <http://www.sterlingrope.com/category/155020/Fire_Rescue>.

NY Assembly Bill A07785—Escape System for NY Firefighters; First Due Training; date last visited Jun. 24, 2010, 2 pages printed from internet; <http://www.firstduetraining.com/bailoutny.html>.

Rapid Intervention Team RIT Bags/Firefighter Bail Out bag Kits; Rescue Response Gear Catalog; date last visited Jun. 24, 2010, 6 pages printed from internet; <http://www.rescueresponse.com/store/Rapid_Intervention_Team_RIT_Bags.html>.

Sam Morton; Sterling Rope Announces The Latest Innovation in Escape Devices—The F4™; Sterling Rope Company, Inc., Press Release; Apr. 10, 2009; 2 pages, Biddeford, Maine, USA.

Sterling F4 Firetech Firefighter Escape System (NFPA 1983-2006); All Hands Fire Equipment Catalog; date last visited Jun. 24, 2010; 2 pages printed from internet; <http://www.allhandsfire.com/STERLING-F4-FIRETECH-FIREFIGHTER-ESCAPE-SYSTEM-NFPA-1983-2006>.

Sterling Rope Debuts Fire Tech 32™ PER New Personal Escape Rope for New York Fire Department; FireRescue1; date last visited Jun. 24, 2010; 2 pages printed from internet; <http://www.firerescue1.com/fire-products/rope-rescue/press-releases/107756.

Sterling Rope F4 Escape Device; Anclote Fire and Safety Inc. Catalog; date last visited Jun. 24, 2010; 3 pages printed from internet; <http://www.anclotefire.com/proddetail.php?prod=STE-F4&cat=8>.

Sterling Rope Hardware F4; Sterling Rope Company, Inc. Catalog; date last visited Jun. 24, 2010; 2 pages printed from internet; <http://www.sterlingrope.com/product/299315/F4/_/F4>.

* cited by examiner

RAPPELLING APPARATUS AND METHOD

CROSS-REFERENCE TO RELATED PATENT APPLICATIONS

This patent application claims the benefit of U.S. Provisional Patent Application No. 61/364,291, filed Jul. 14, 2010, the entire teachings and disclosure of which are incorporated herein by reference thereto.

FIELD OF THE INVENTION

This invention generally relates to an apparatus and method for rappelling, and more particularly to a rappelling apparatus and method suitable for a wide variety of activities including, but not limited to, recreational rappelling, emergency use by firefighters needing to exit a building or other elevated structure, and military or law enforcement activities.

BACKGROUND OF THE INVENTION

There are many situations in which it is desirable to have a light-weight, compact rappelling apparatus and methods for its use. For example, despite the best efforts of firefighters and their supervisors to provide training and on-scene coordination, situations can develop in which a firefighter becomes trapped on an upper floor of a building or other structure. It is highly desirable to provide firefighters with a compact, light-weight and reliable apparatus and method for rappelling from the upper level of the involved building or structure to a safer location at a lower level where they can proceed to safety on their own or be aided by other emergency personnel in affecting a safe exit. It is also desirable that such a rappelling apparatus and method include a fail-safe provisions which will automatically lock and hold the firefighters suspended in a rappelling apparatus in the event that the firefighters should be knocked unconscious or become otherwise incapable of safely operating the rappelling apparatus. These apparatuses are sometimes referred to as "bail-out systems.

Depending upon applicable regulations, it is also desirable in some forms of such an emergency rappelling apparatus and method that a nominal decent rate be maintained even if the person suspended by the rappelling apparatus is unconscious. With such an arrangement, it may also be desirable to allow operation of the rappelling apparatus by a conscious person to control the descent rate to a rate faster or slower than the nominal rate for an unconscious person.

BRIEF SUMMARY OF THE INVENTION

The invention provides a rappelling apparatus and method, for controlling the rate of movement of a person along a safety line away from an anchored end of the safety line, through use of a control bar having an attachment at one end thereof for a harness safety belt, or the like connected to the person, an operating handle at an opposite end thereof, and provisions between the opposite ends of the control bar for passage of the safety line through the control bar in an S-shaped pattern. The relative locations of attachment of the support harness or belt and a point of initial entry of the safety line through the control bar are such that, with the proximal end of the safety line anchored and weight or other forces acting on the safety harness, the control bar inherently assumes a position whereby the safety line forms a tight U-shaped bend in passing through the control bar for a first time. The tight U-shaped bend, in combination with other features of the control bar results in the rappelling apparatus and method providing a controlled rate of passage of the safety line through the control bar. To increase the rate of movement of the safety line through the control bar, the operating handle end of the control bar is pivoted away from the safety line to reduce the degree of severity of the U-shaped bend.

In some forms of the invention, the control bar may also include a one-way clutching arrangement. Some forms of the invention may also include a hand-operable braking arrangement for applying a braking force to the safety line in addition to the control of the rate of passage of the safety line through the control bar provided by the construction of the control bar. Some forms of the invention include both a one-way clutching arrangement and a braking arrangement. The braking arrangement may be configured and operatively attached to the control bar in such a way that both the basic operation of the control bar and the braking arrangement can be simultaneously accomplished by one hand of a person utilizing a rappelling apparatus according to the invention.

In one form of the invention, a rappelling apparatus is provided for controlling movement of a person wearing a harness, or the like, along a safety line anchored at a proximal end of the safety line with the safety line having a length of the safety line extending away from the proximal end thereof and terminating at a distal end of the safety line. The control bar has a body thereof defining a length of the control bar extending along a longitudinal axis of the control bar between first and second ends of the control bar. The body of the control bar also defines a width of the control bar extending substantially orthogonally to the longitudinal axis, and a thickness of the control bar extending substantially orthogonally to both the longitudinal axis and the width of the control bar.

In describing the operation or construction of an apparatus or method herein, according to the invention, terms such as "descent" and "movement along the safety line" are not intended to be limiting. Where the invention is used to descend from an upper to a lower level, the term "descent" may be applicable. In other uses, where an apparatus or method according to the invention is utilized to anchor a person moving across a relatively level surface, against the force of wind water or waves, for example, movement along the safety line may not involve actual descent. It is contemplated that, while an apparatus or method according to the invention is particularly well suited for use in bail-out systems, the invention may be utilized in many other rappelling, climbing or safety line applications.

The first end of the control bar is adapted for attachment thereto of the harness, or the like. As used herein, the term "harness" is intended to include any appropriate means of attaching a person using a rappelling apparatus or method, according to the invention, to the first end of a control bar according to the invention. It is expressly contemplated that such attachment arrangements may include, but not be limited to: a safety harness, a belt, a vest, other forms of clothing, and/or any form of straps or other intermediate devices for accomplishing such attachment.

The body of a control bar, according to the invention defines first, second and third through-holes extending through the thickness of the body of the control bar. The three through-holes are sequentially aligned along the longitudinal axis, with the first through-hole being disposed closest to the first end of the control bar, the third through-hole being disposed farthest from the control bar, and the second through-hole being disposed between the first and third through-holes.

The through-holes are adapted for sequential passage therethrough of the safety line. The distal end length of the safety line slidingly and sequentially pass through the thickness of the control bar a first time through the first through-hole and then back through the thickness of the control bar a second time through the second through-hole. The distal end and length of the safety line passes through and exits the thickness of the control bar a third time through the third through-hole, in such a manner that the safety line follows a substantially S-shaped path through the three through-holes.

The first through-hole also substantially defines a control bar pivot axis extending across the width of the body of the control bar and disposed substantially at the first through-hole, such that the control bar pivot axis is disposed closer to the first end of the control bar than to the second end of the control bar.

A portion of the body of the control bar extending between the third through-hole and the second end of the control bar is configured to form an operating handle of the control bar.

By virtue of the above described configuration of the rappelling apparatus, according to the invention, when tension is applied to the safety line by a load acting through the harness or the like, attached to the first end of the control bar, the operating handle of the control bar is inherently urged toward a non-actuated, safety position thereof in which the second end of the control bar points generally along the portion of the safety line in tension toward the proximal end of the safety line. With the second end of the control bar thus oriented in the non-actuated safety position, the portion of the safety line under tension forms a tight U-shaped bend in passing through the first through-hole in the control bar which, in combination with the remainder of the S-shaped path of the safety line through the second and third through-holes in the control bar serves to create substantial friction and significant retards passage of the safety line through the through-holes of the control bar.

As a further consequence of the above described configuration of the rappelling apparatus, according to the invention, when the operating handle is actively operated to pivot the second end of the control bar away from the safety position, the U-shaped bend of the safety line passing through the first through-hole becomes less severe, thereby reducing friction on the safety line and allowing for more rapid passage of the safety line through the three through-holes in the control bar, when a load is being applied to the first end of the control bar.

In some forms of the invention, the safety line is locked against passage through the control bar when the operating handle is in the non-actuated safety position. In some forms of the invention, resistance to passage of the safety line through the control bar decreases as the second end of the control bar is pivoted farther away from the safety position.

By virtue of its construction, whenever the operating handle is urged toward the safety position, either through active movement by a person utilizing the rappelling arrangement or whenever no external force is applied to the operating handle while the load is applied to the first end of the control bar, the operating handle will move toward the safety position.

In some forms of the invention, a rappelling apparatus or method may also include components in addition to the control bar, such as: a safety line; a harness or the like; an anchoring arrangement for anchoring the proximal end of the safety line; an adapter arrangement for connecting the first end of the control bar to a harness or the like; a container for storage of all or a part of the rappelling arrangement; an item of apparel having a compartment for storage of the rappelling arrangement; and/or any other component or accessory for utilizing a rappelling apparatus and/or method according to the invention.

In some forms of a rappelling apparatus, according to the invention, the first end of a control bar according to the invention may include a fourth through-hole therein for attachment of the control bar to the harness or the like.

In some forms of the invention, a rappelling apparatus and/or method may further include a one-way clutch arrangement operatively disposed for resisting passage of the safety lien through the control bar. In some forms of the invention, such a one-way clutch arrangement may be disposed between the first and second through-holes for resisting passage of the safety line through the control bar when the control bar is in the safety position. In some forms of a one-way clutch, according to the invention, the portion of the safety line extending between the first through-hole of the control bar and the anchor point may serve to actuate the one-way clutch.

In various forms of the invention utilizing a one-way clutch, the one-way clutch arrangement may take an appropriate form including, but not limited to: a moveable ball arrangement; a pivotable cam arrangement; or a slideable cam arrangement. A cam arrangement, according to the invention may include a cam having an outer surface thereof including multiple shapes or facets for contacting the safety line. A pivotable cam, in a one-way clutch arrangement according to the invention may be eccentrically mounted.

In a rappelling apparatus or method according to the invention, a control bar may also include one or more wear-resistant elements disposed in at least a portion of the one of the through-holes. A control bar according to the invention may also include at least one surface thereof which is configured for enhancing locking of the safety line in the safety position and/or for enhancing release of the safety line when the operating handle is pivoted away from the safety position.

Some forms of a control bar, according to the invention, may also include a recess and/or other provisions for orienting and/or guiding the portion of the safety line between the first through-hole and the anchor point with respect to the longitudinal axis of the control bar as the safety line exits or is aligned adjacent to the control bar.

In some forms of the invention, a hand-actuated braking arrangement is operatively attached to the control bar for selectively applying a braking force to the safety line as the safety line passes through the body of the control bar. The braking arrangement may include a braking lever having a proximal end thereof pivotably attached to the control bar and a braking surface adjacent a distal end thereof configured for bearing against the safety line and urging the safety line against a side of the third hole in the control bar, when the braking lever is hand-actuated as the safety line passes through the body of the control bar. A braking arrangement according to the invention may also include a braking lever travel limiting arrangement to constrain the braking lever for movement between a no-braking position and a full-braking position. A braking lever, according to the invention, may be configured and attached to the control bar in such a manner that a hand grasping the operating handle of the control bar can also selectively move the braking lever between the no-braking and the full-braking position while simultaneously moving the operating handle toward and away from the safety position.

In a pivotable cam, according to the invention, the cam may be configured to pivot eccentrically about a pivot axis, and also have a periphery thereof shaped to preferentially grip the safety line more tightly in one direction than the other.

The invention may also take the form of a method for constructing and/or operating a rappelling apparatus in accordance with the invention.

Other aspects, objects and advantages of the invention will be apparent from the following description and drawings of various exemplary embodiments of the invention.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIGS. 35 and 36 respectively show the braking arrangement in a non-braking position and in a braking position respectively.

Figure 1:
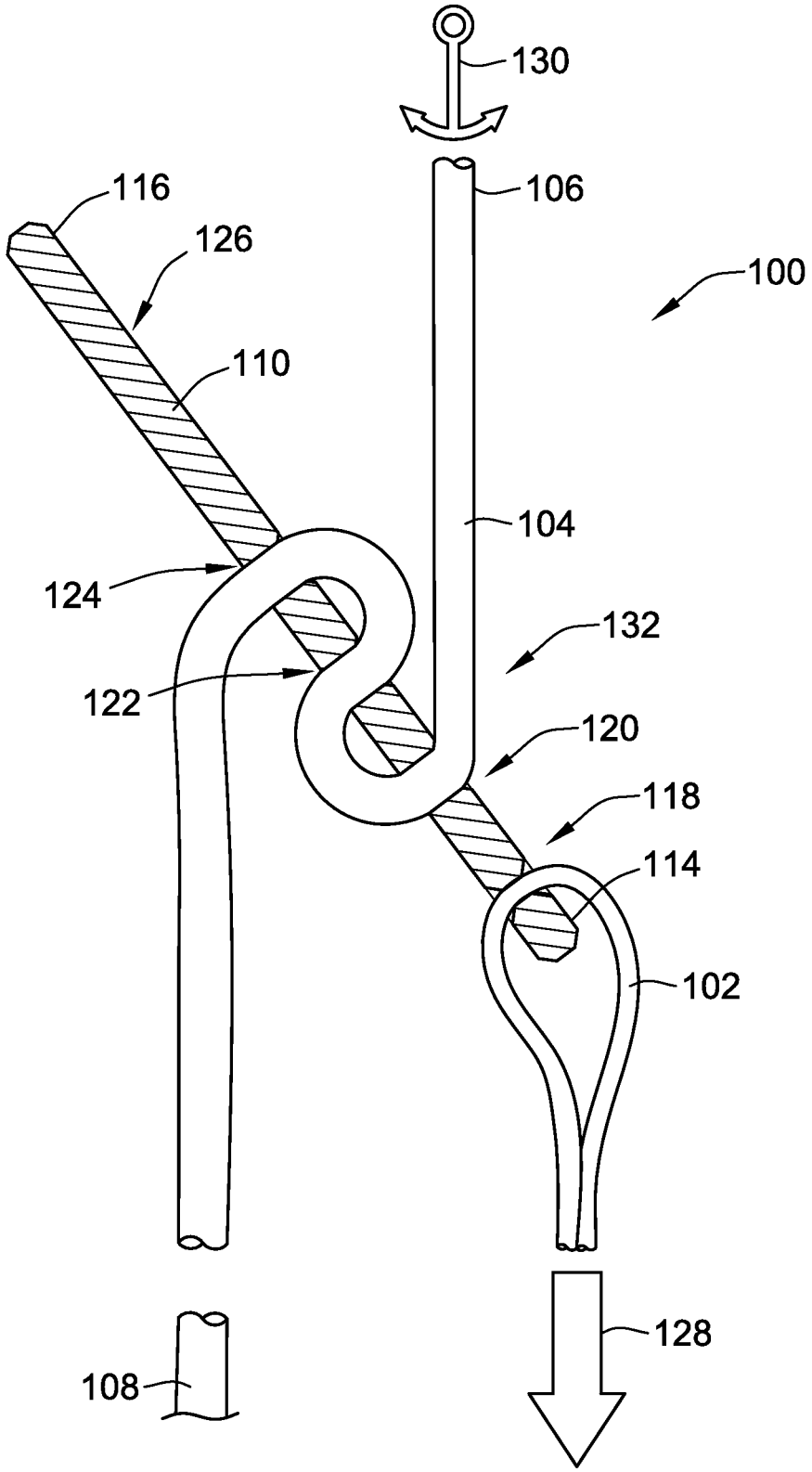
FIGS. 1-5 illustrate a first exemplary embodiment of a rappelling apparatus, according to the invention, with FIGS. 1 and 2 showing the first exemplary embodiment in an un-actuated safety position, and in a descending position respectively.

While the invention will be described in connection with certain preferred embodiments, there is no intent to limit it to those embodiments. On the contrary, the intent is to cover all alternatives, modifications and equivalents as included within the spirit and scope of the invention. In order to facilitate understanding of the exemplary embodiments, a standardized numbering convention has been utilized throughout the drawing figures of the various embodiments. In the drawings, each exemplary embodiment is incremented by one hundred over the previously described exemplary embodiment with the remainder to each reference numeral being kept as consistent as possible between the various exemplary embodiments.

DETAILED DESCRIPTION OF THE INVENTION

Figure 2:
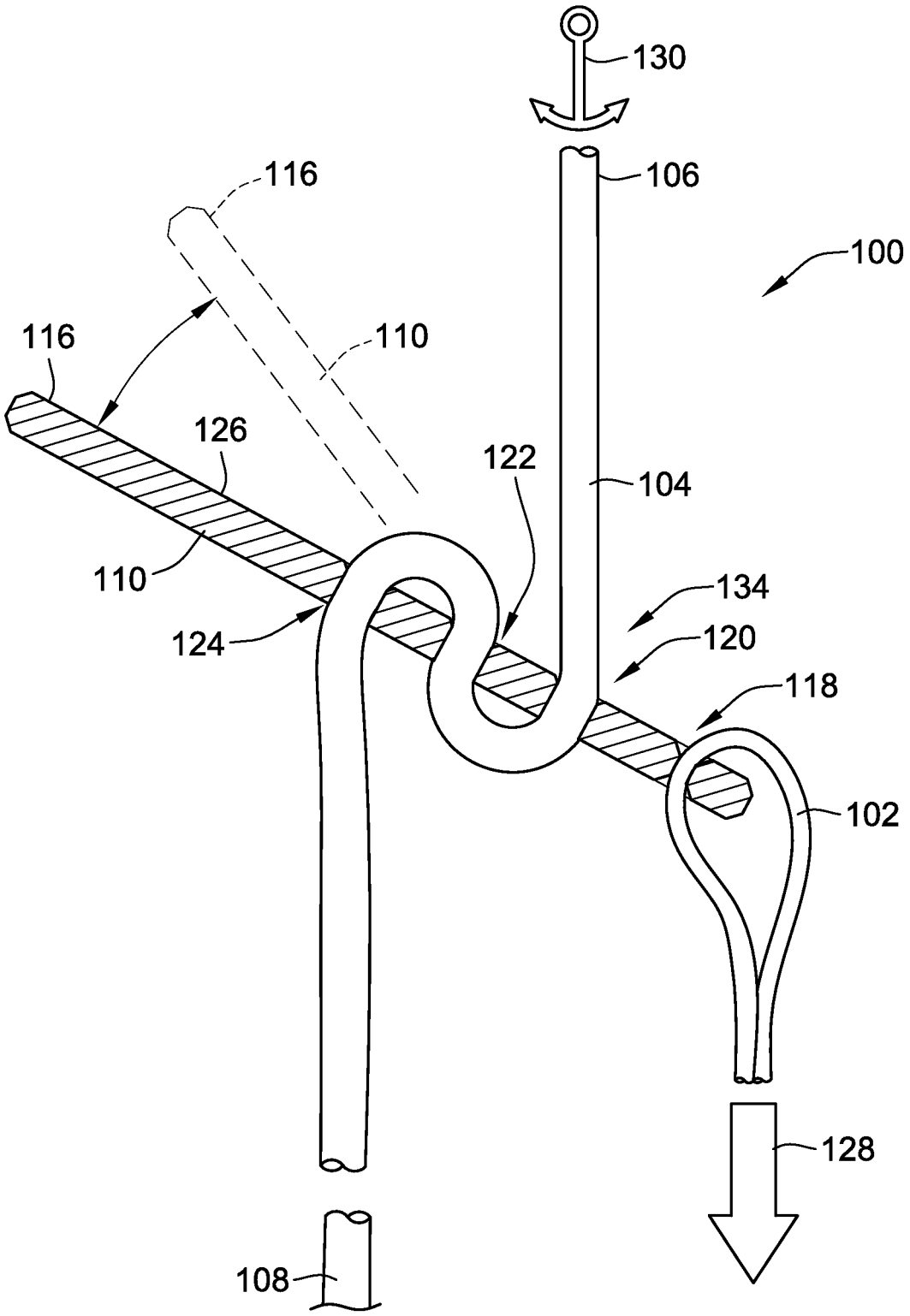
Figure 3:
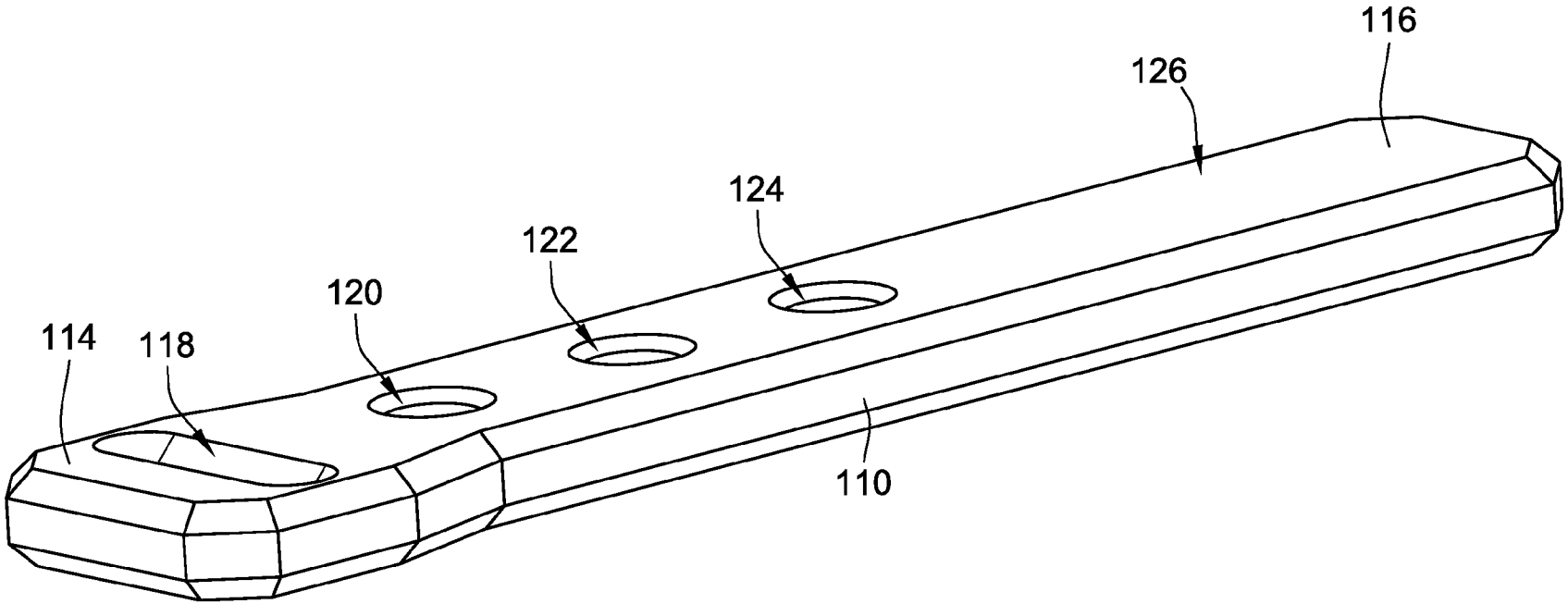

FIGS. 1 and 2 show a first exemplary embodiment of a rappelling apparatus 100, according to the invention, for controlling descent of a person (not shown) wearing a harness 102 along a safety line 104 anchored at a proximal end 106 of the safety line 104. The safety line 104 has a length of the safety line 104 extending away from the proximal end 106 of the safety line 104 and terminating in a distal end 108 of the safety line 104. FIG. 1 shows the rappelling apparatus 100 in a non-actuated safety position, and FIG. 2 shows the first exemplary embodiment of the rappelling apparatus 100 in an actuated position wherein a person supported by the harness 102 is being lowered at a controlled rate by the rappelling apparatus.

As shown in FIGS. 1-5, the first exemplary embodiment of the rappelling apparatus 100 includes a control bar 110 having a body defining a length L of the control bar 110 extending along a longitudinal axis 112 of the control bar, between first and second ends 114, 116 of the control bar 110. The body of the control bar 110 also defines a width W of the control bar 110 extending substantially orthogonally to the longitudinal axis 112, and a thickness T of the control bar extending substantially orthogonally to both the longitudinal axis 112 and the width W of the control bar 110.

The first end 114 of the control bar 110 includes an elongated slot, to thereby adapt the first end 114 for attachment thereto of the harness 102.

The body of the control bar 110 defines first, second and third through-holes 120, 122, 124, extending through the thickness T of the body of the control bar 110. The three through-holes 120, 122, 124 are sequentially aligned along the longitudinal axis 112, with the first through-hole 120 being disposed closest to the first end 114 of the control bar 110. The third through-hole 124 is disposed farthest from the first end 114 of the control bar 110, and the second through-hole 122 is disposed between the first and third through-holes 120, 124.

As shown in FIGS. 1 and 2, the through-holes 120, 122, 124 are adapted for sequential passage therethrough of the safety line 104, with the distal end 108 and most of the length of the safety line 104 slidingly and sequentially passing through the thickness T of the control bar 110 a first time through the first through-hole 120, then back through the thickness T of the control bar 110 a second time through the second through-hole 122, and finally passing through and exiting the thickness T of the control bar 110 a third time through the third through-hole 124, so that the safety line 104 follows a substantially S-shaped path through the three through-holes 120, 122, 124.

Figure 4:
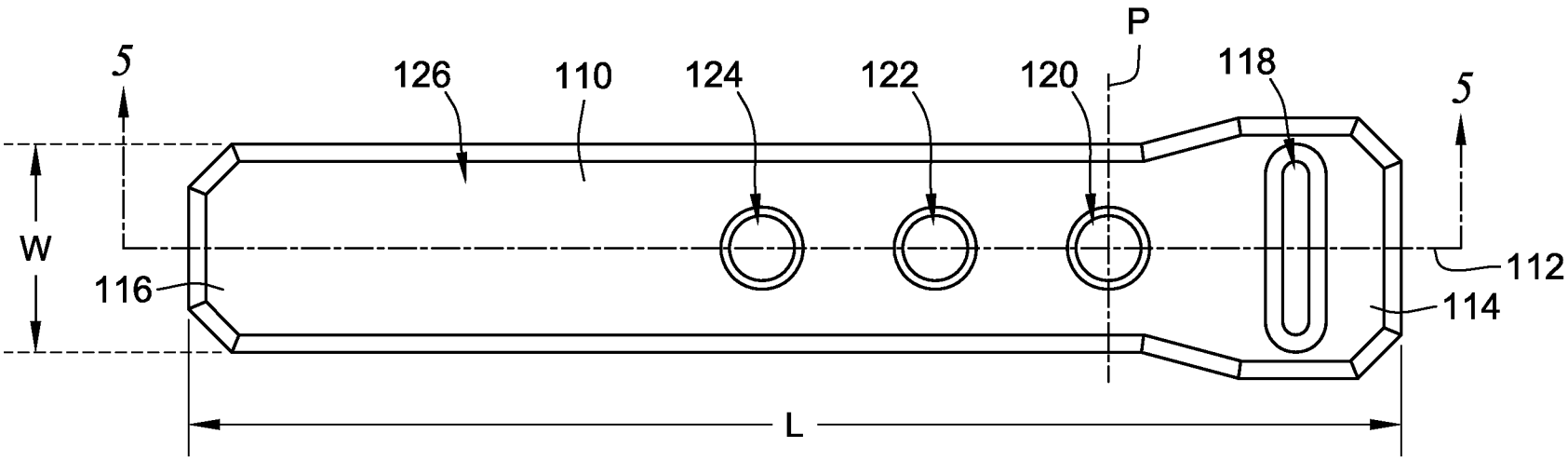
Figure 5:
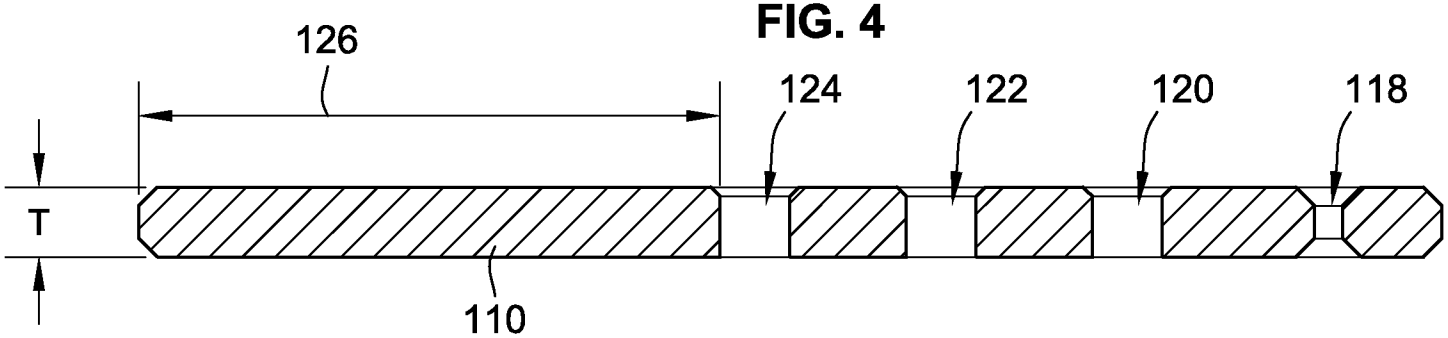
Figure 6:
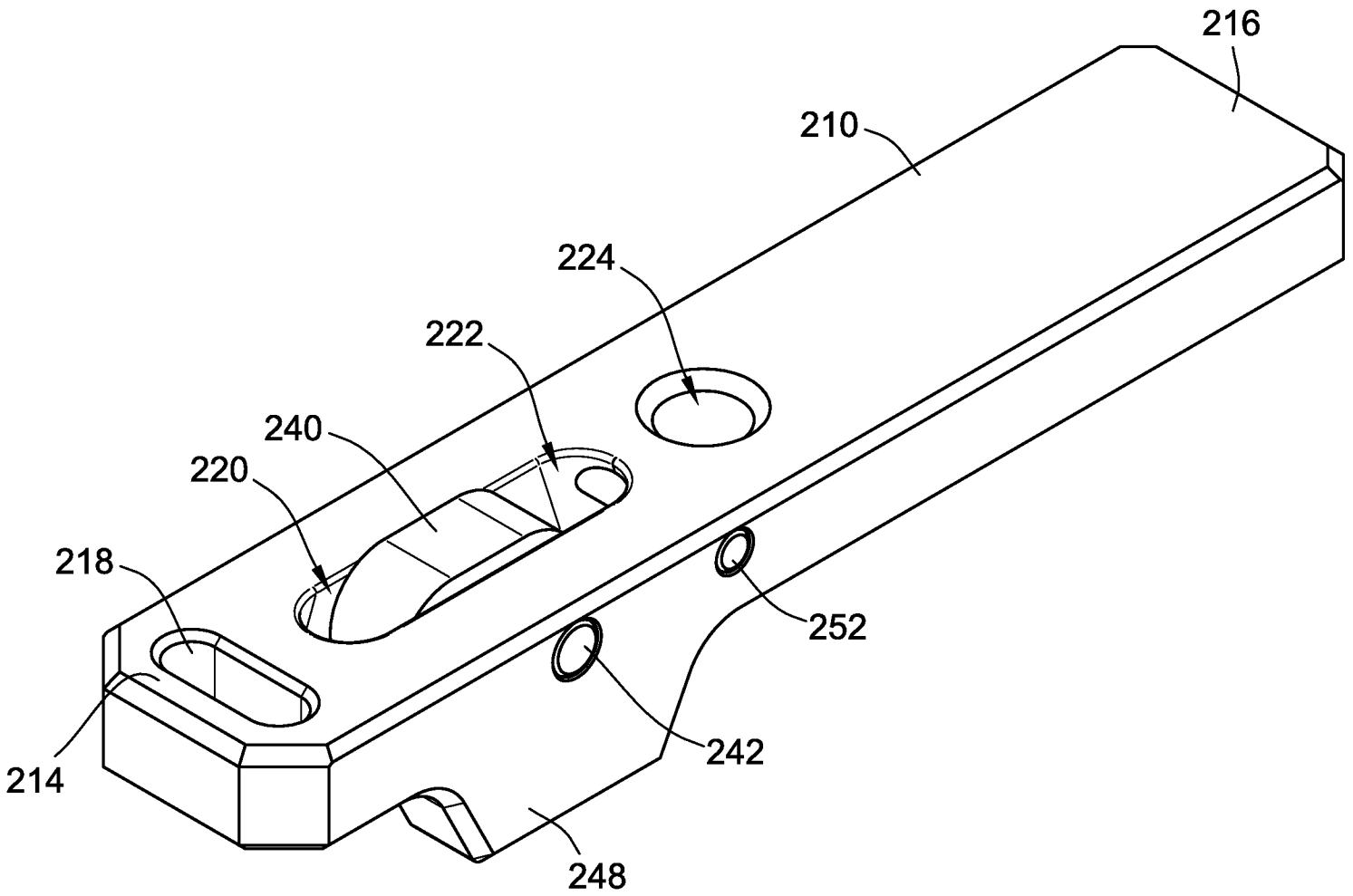
FIGS. 6-11 show a second exemplary embodiment of a rappelling apparatus, according to the invention, with FIGS. 10 and 11 showing the second exemplary embodiment in an un-actuated safety position and a descending position respectively. The second exemplary embodiment includes a one-way clutch arrangement having a pivotable cam.
Figure 7:
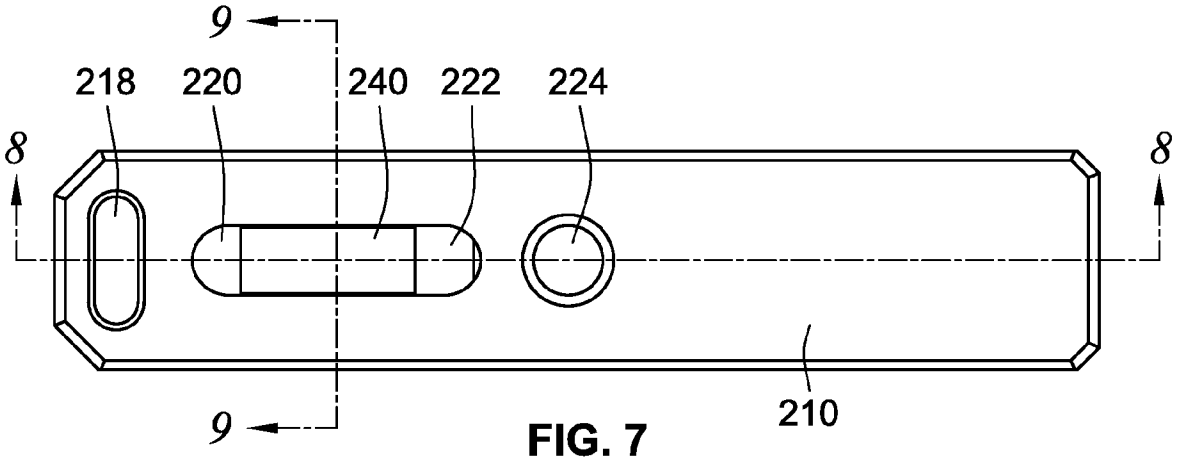

As shown in FIG. 4, the first through-hole 120 also substantially defines a control bar pivot axis P extending across the width W of the body of the control bar 110 and disposed substantially at the first through-hole, such that the control bar pivot axis P is disposed closer to the first end 114 of the control bar 110 than to the second end 116 of the control bar 110.

A portion of the body of the control bar 110 which extends between the third through-hole 124 and the second end 116 of the control bar 110 is configured to form an operating handle 126 of the control bar 110.

By virtue of the above-described configuration of the first exemplary embodiment of the rappelling apparatus 100, when tension is applied to the safety line by a load 128 acting through the harness 102 on the first end 114 of the control bar 110, the operating handle 126 is urged toward a non-actuated safety position thereof, as generally indicated in FIG. 1, with the second end 116 of the control bar 110 pointing generally toward the proximal end 106 of the safety line 104. Those having skill in the art will recognize that absent any force being applied to the operating handle 126, the relative positions of the load 128, the anchor 130, and in particular the manner in which the first end 114 of the control bar 110 is configured and disposed with respect to the location of the first through-hole 120 along the control bar 110, results in the control bar 110 being pulled toward substantial alignment with the load and the anchor 128, 130. As the control bar 110 is pulled toward substantial alignment between the load 128 and the anchor 130, the safety line 104 exiting the first through-hole 120 forms a tight U-shaped bend 132 which, in combination with the S-shaped path of the safety line 104 through the through-holes 120, 122, 124 creates substantial resistance to motion of the safety line 104 through the control bar 110. In some embodiments of the invention, the rappelling apparatus 100 is configured such that when no force is applied to the operating handle 126, the control bar 110 essentially precludes all motion of the safety line 104 through the control bar 110 to thereby effectively maintain the person in the safety harness 102 at a fixed location with respect to the anchor 130.

As shown in FIG. 2, when it is desired to allow movement of the safety line 104 through the control bar 110, the operating handle 126 is pivoted away from the anchor 130, in the manner illustrated by dashed and solid lines in FIG. 2. As the operating handle 126 is pivoted away from the safety position shown in FIG. 1, the severity of the U-shaped bend 132 is reduced to form a substantially J-shaped bend 134, as shown in FIG. 2. As the severity of the bend in the safety line 104 at its point of entry and passage through the first through-hole 120 is reduced, resistance to motion of the safety line 104 through the control bar 110 is reduced, to thereby allow controlled movement of the load 128 away from the anchor 130. In some embodiments of the invention, the various components of a rappelling apparatus, according to the invention, are selected and configured to provide a desired descent rate for a load of a given weight or value. For example, it is contemplated that in some embodiments of the invention a rappelling apparatus and/or method may be configured to provide a controlled descent rate of six feet per second at a preselected pivot angle of displacement of the operating handle 126. In some embodiments of the invention, the resistance to movement of the safety line 104 through the operating handle 110 follow a functional relationship between the degree of angular displacement of the operating handle away from the anchor 130, so that the farther the operating handle 126 is moved away from alignment with the anchor 130, the lower the resistance and the faster the safety line 104 will pass through the control bar 110.

In some forms of the invention, a rappelling apparatus and/or method will be configured such that a desired range of loads can be lowered at a controlled rate for a given configuration. By making slight modification to the control bar and/or other components such as the safety line, a family of apparatuses can be provided which are tailored to specific ranges of loads. In this manner, the device may be matched to the weight of a given user, such as a firefighter.

The manner of operating the operating handle 126 is illustrated in the attached photos 6-8. As shown in photos 6 and 7, a person supported by the harness 102 may simply grasp the operating handle 126 directly and pull it away from the safety position indicated in FIG. 1. Alternatively, as illustrated in the attached photo 11, the operating handle 126 may be actuated by pulling on the safety line 104 extending out of the third through-hole 124 to pull the operating handle 126 away from the safety position shown in FIG. 1.

Some embodiments of a rappelling apparatus and/or method, according to the invention, include a one-way clutching arrangement.

FIGS. 6-11 illustrate a second exemplary embodiment of a rappelling apparatus 200, according to the invention, including a control bar 210 constructed in a similar manner to the first exemplary embodiment of the control bar 110 described above, except that the control bar 210 of the second exemplary embodiment 200 includes a one-way clutching arrangement 238. As best seen in FIGS. 8-11, the one-way clutching arrangement 238 of the second exemplary embodiment 200 includes an eccentrically mounted pivotable cam 240, mounted for pivoting movement around a cam pivot axle 242.

Figure 8:
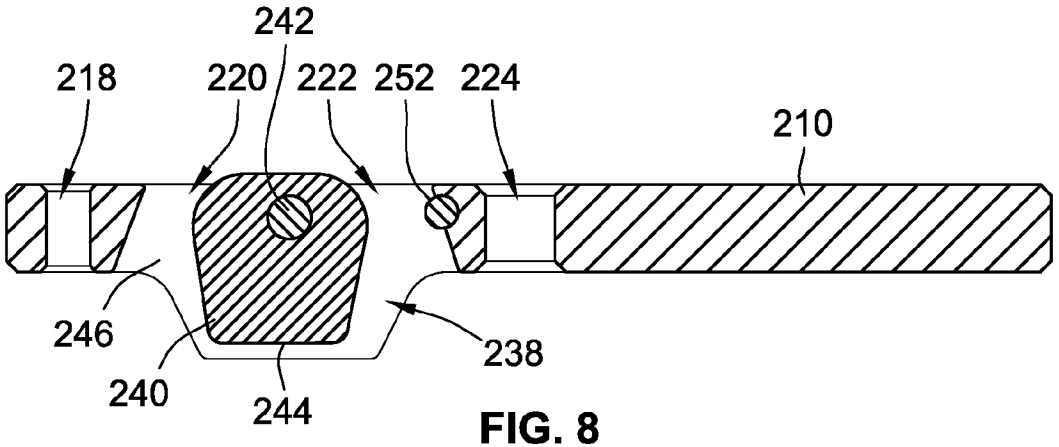
Figure 9:
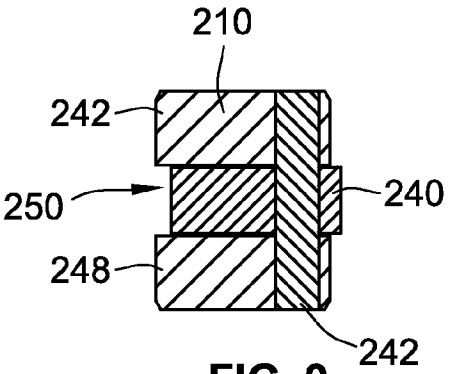
Figure 10:
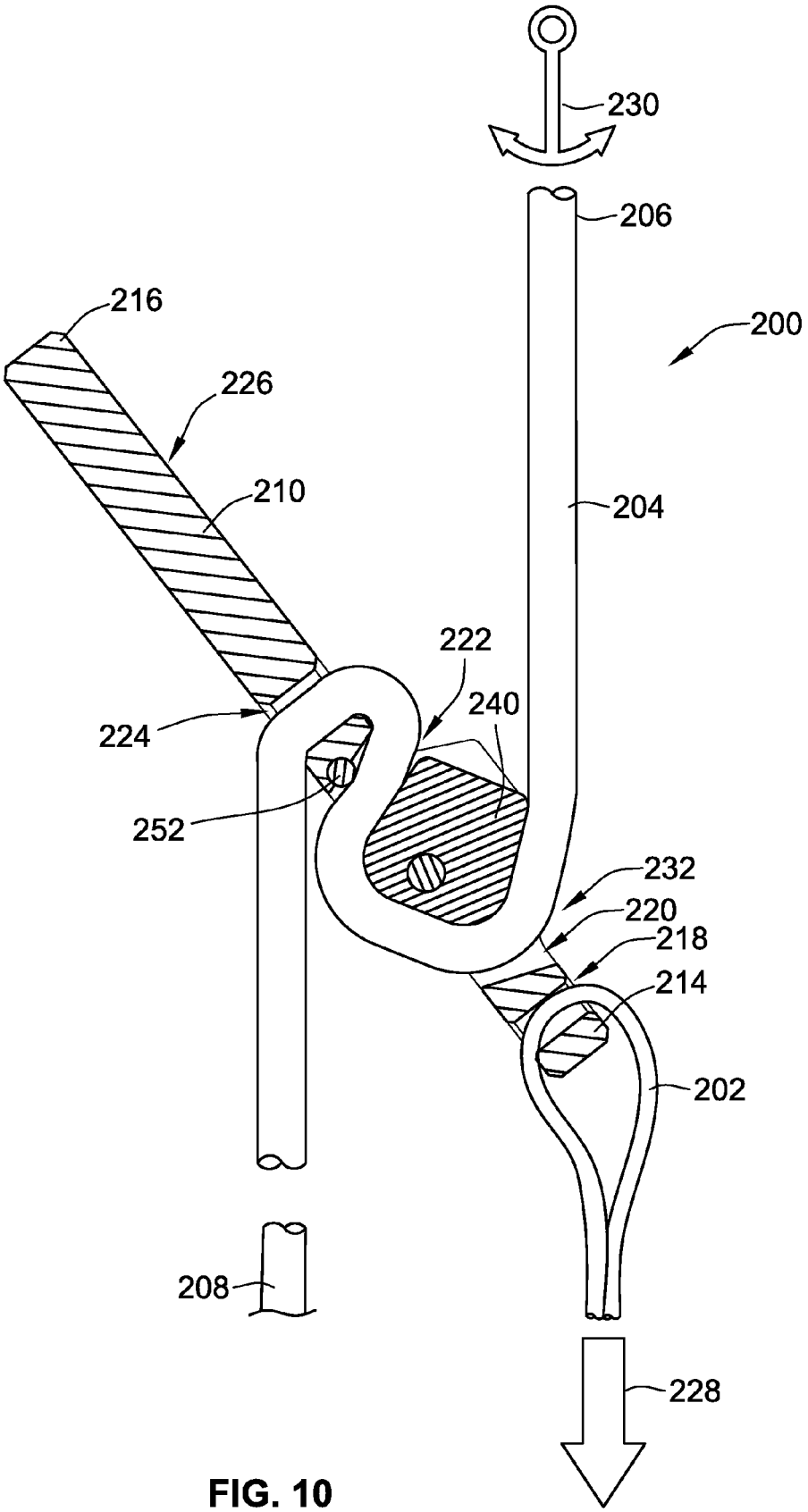
Figure 11:
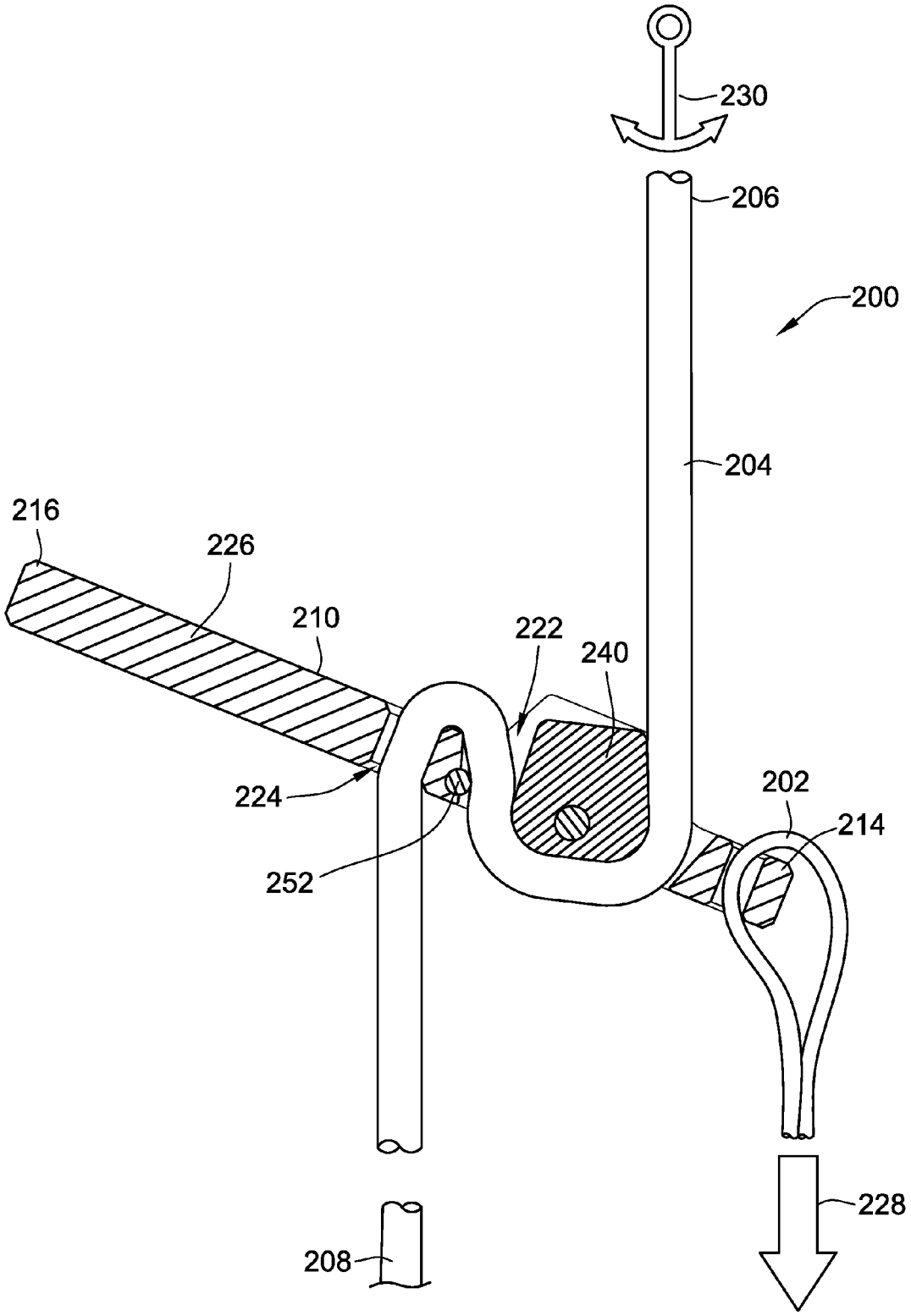
Figure 12:
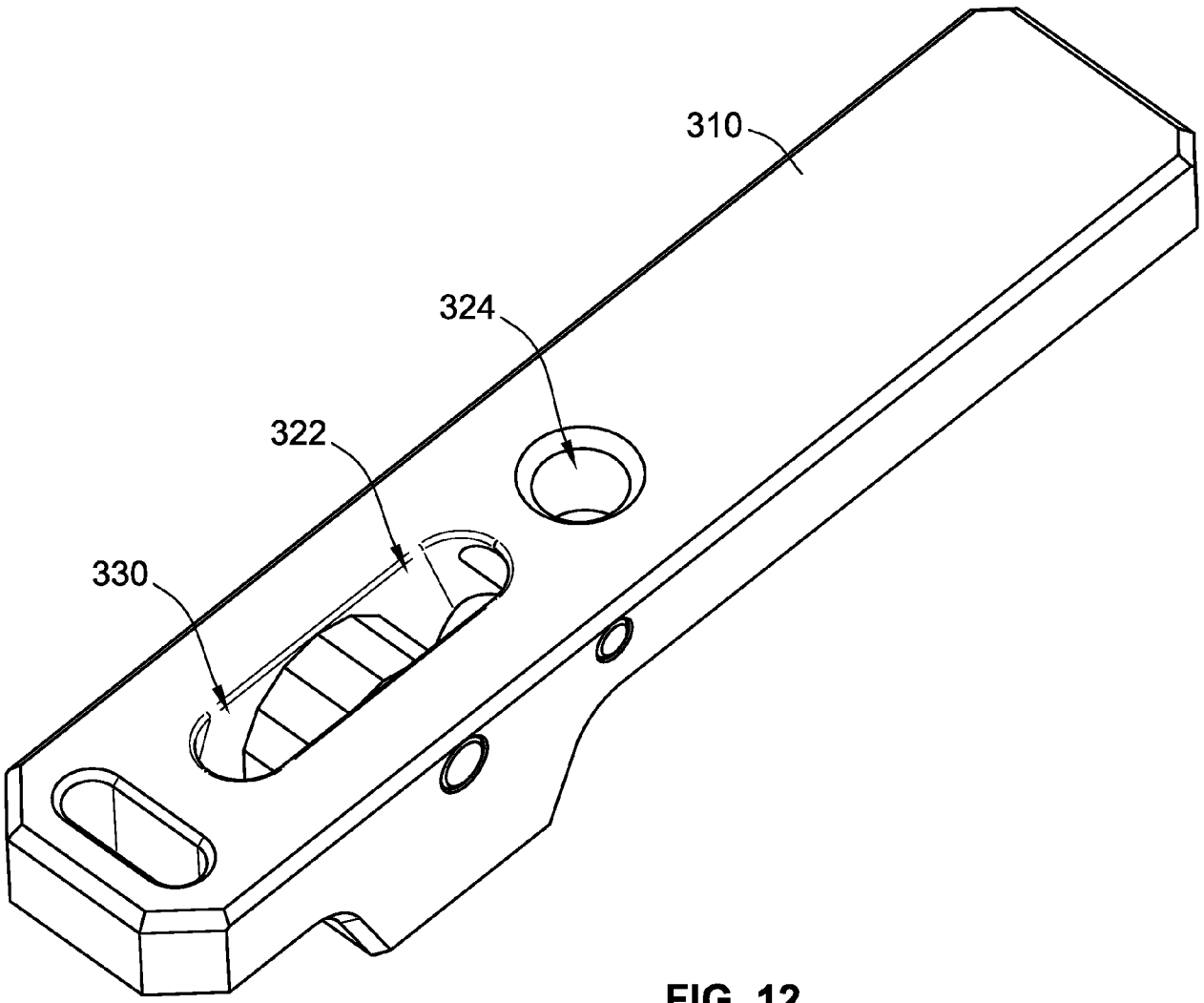
FIGS. 12-16 show a third exemplary embodiment of a rappelling apparatus, according to the invention, with FIGS. 15 and 16 showing the third exemplary embodiment in an un-actuated safety position and a descending position respectively. The third exemplary embodiment includes a one-way clutch arrangement having a pivotable cam.
Figure 13:
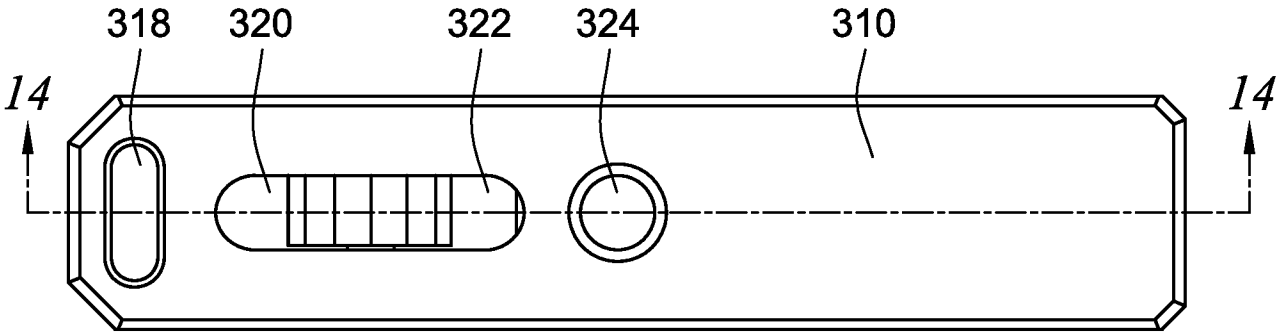
Figure 14:
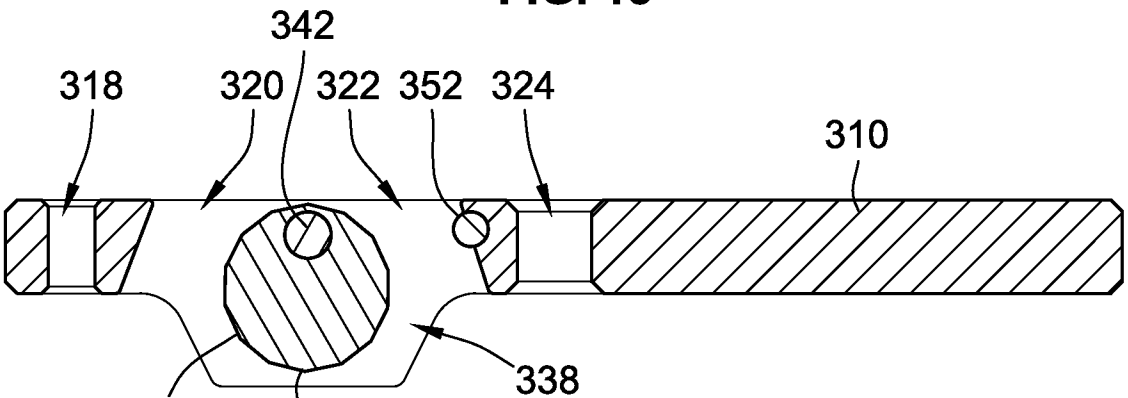
Figure 15:
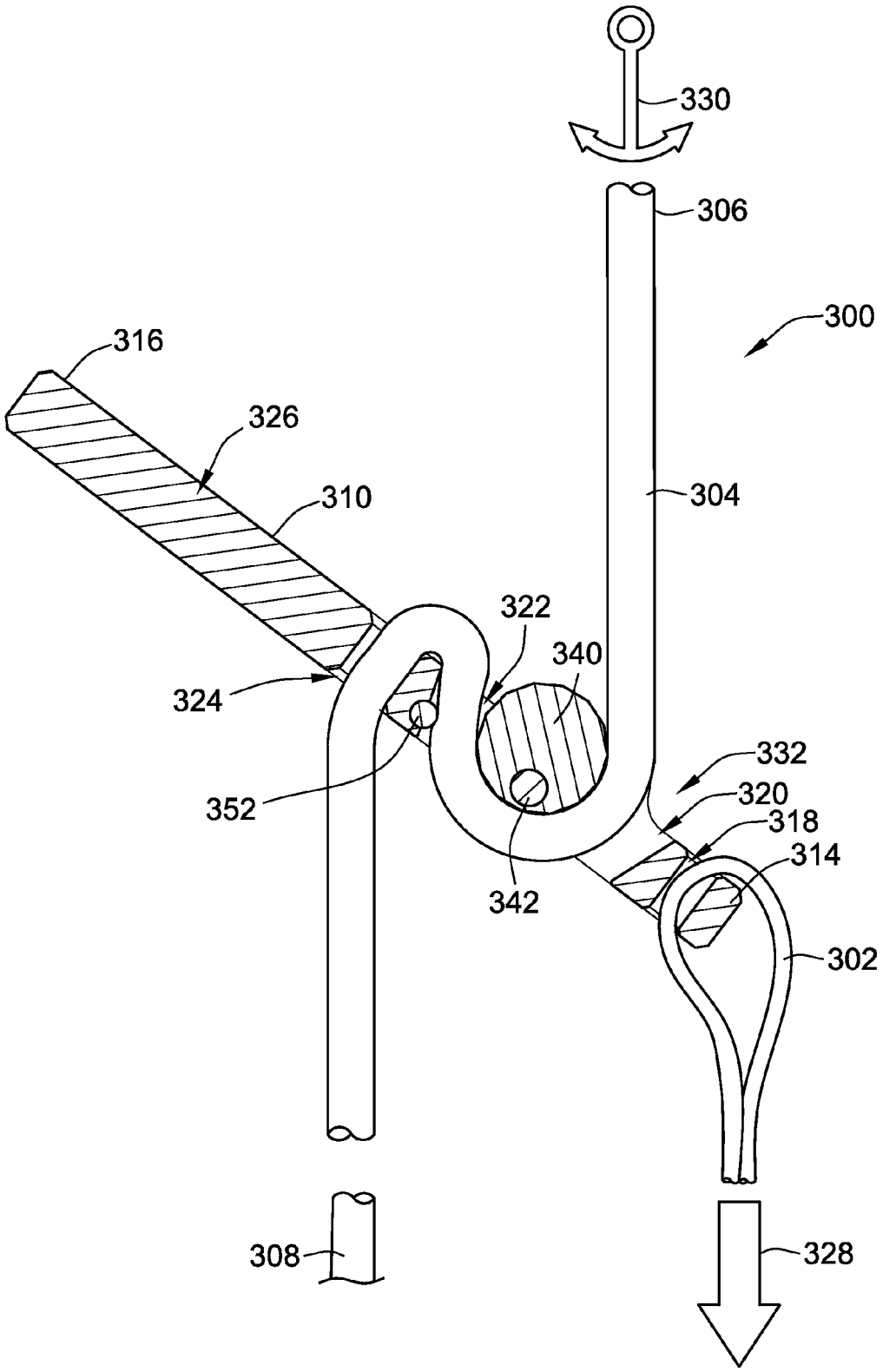
Figure 16:
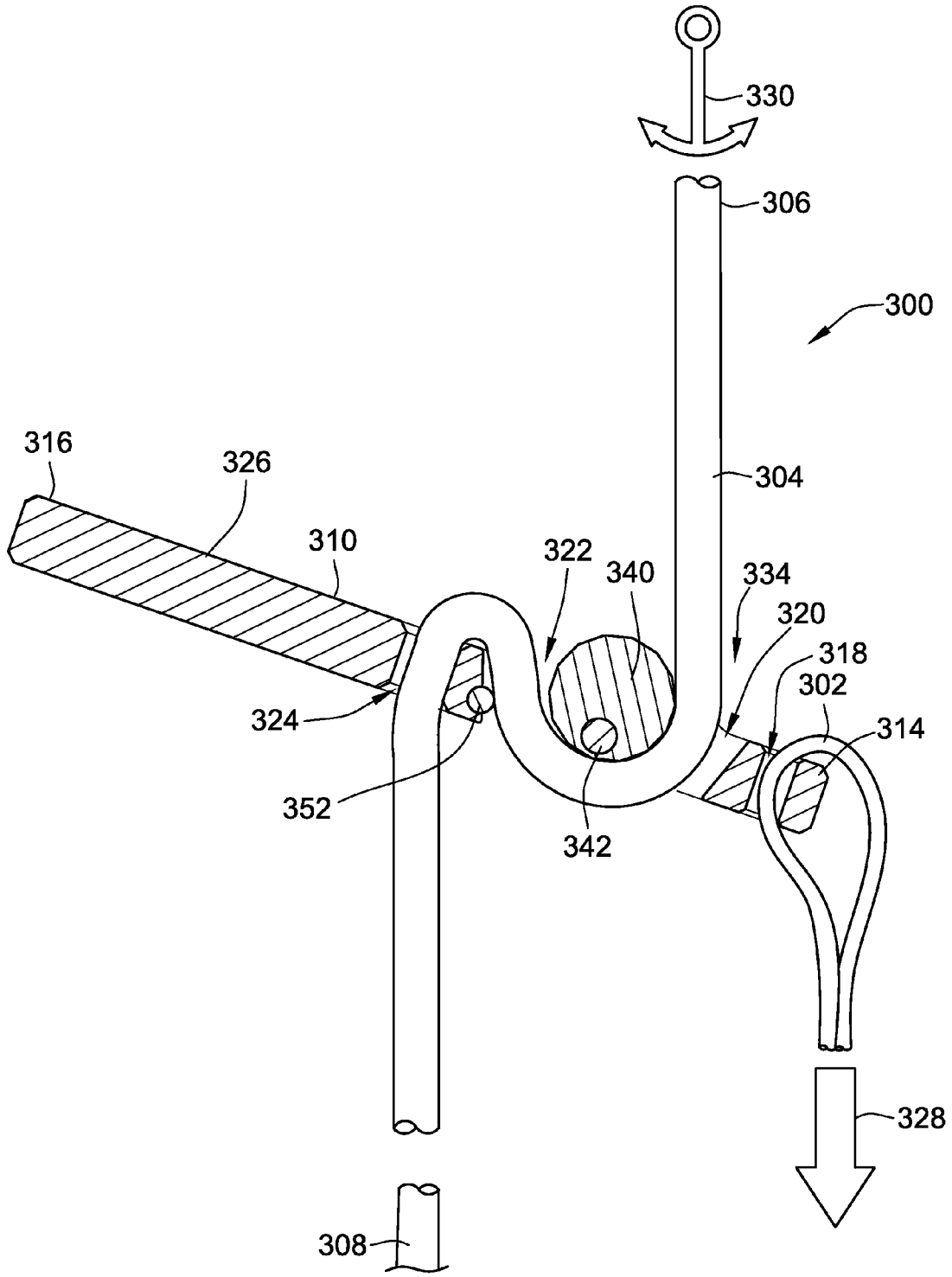
Figure 17:
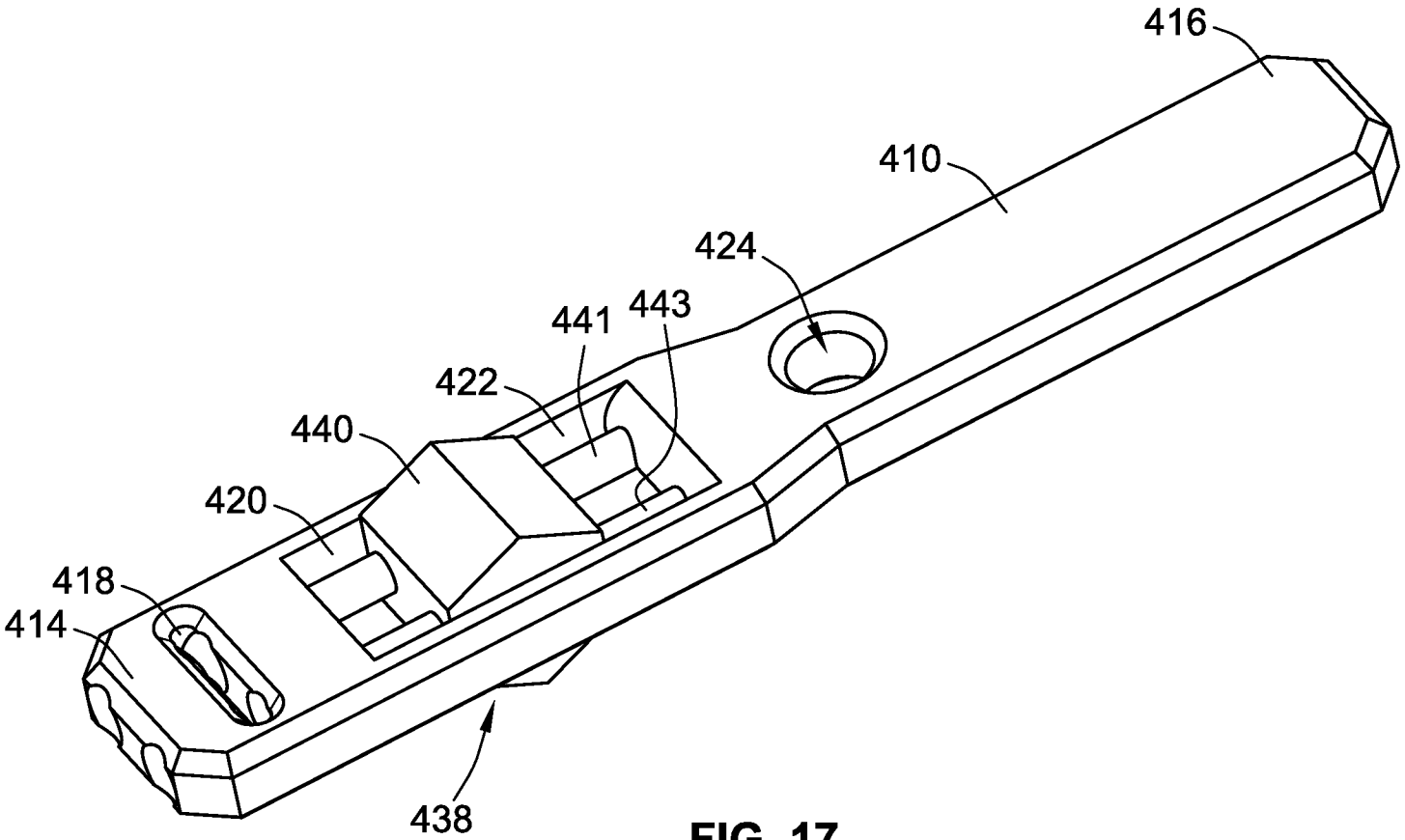
FIGS. 17-21 show a fourth exemplary embodiment of a rappelling apparatus, according to the invention, with FIGS. 20 and 21 showing the fourth exemplary embodiment in an un-actuated safety position and a descending position respectively. The fourth exemplary embodiment includes a one-way clutch arrangement having a sliding cam.
Figure 18:
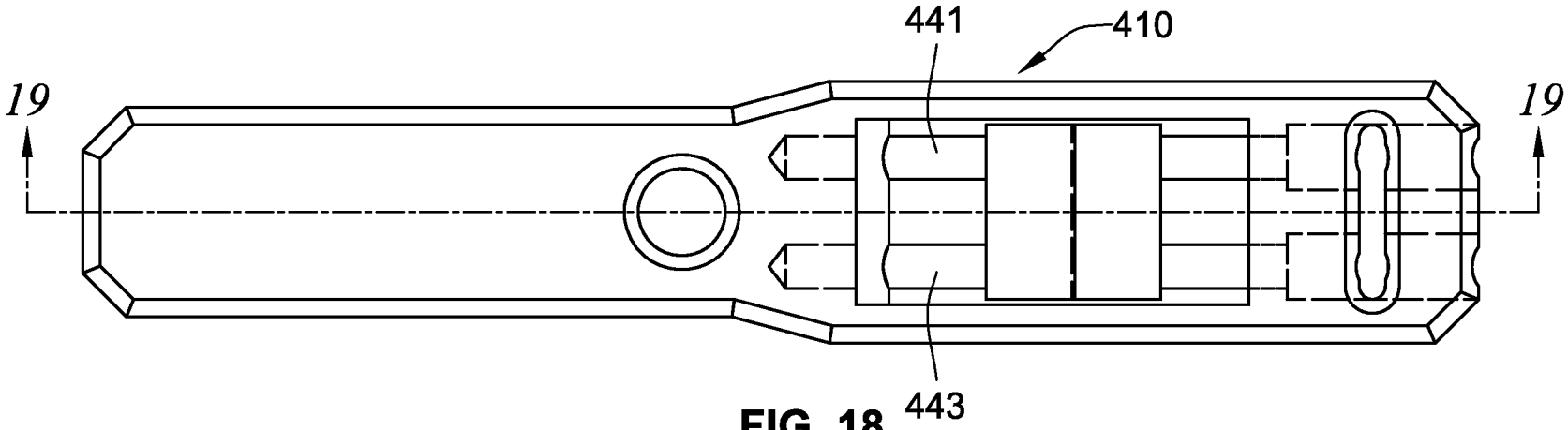
Figure 19:
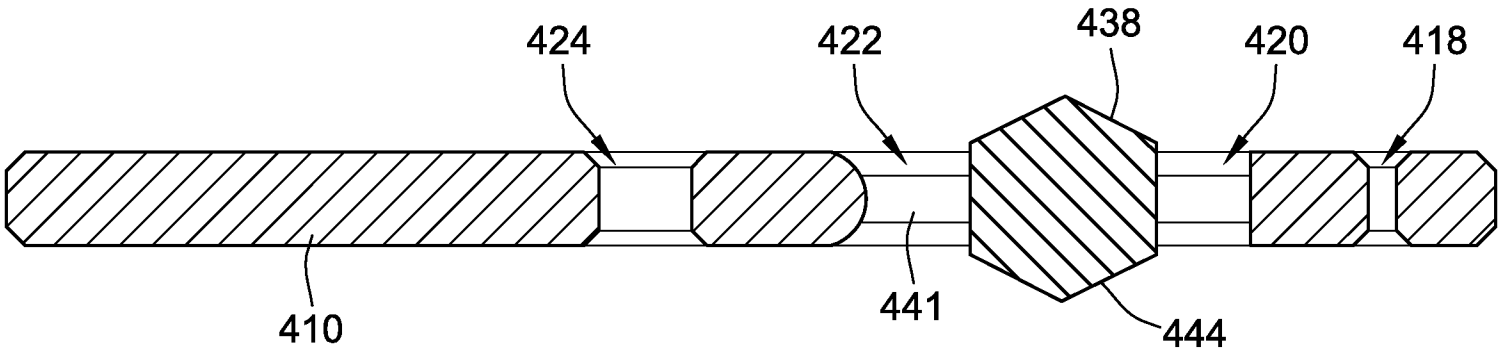
Figure 20:
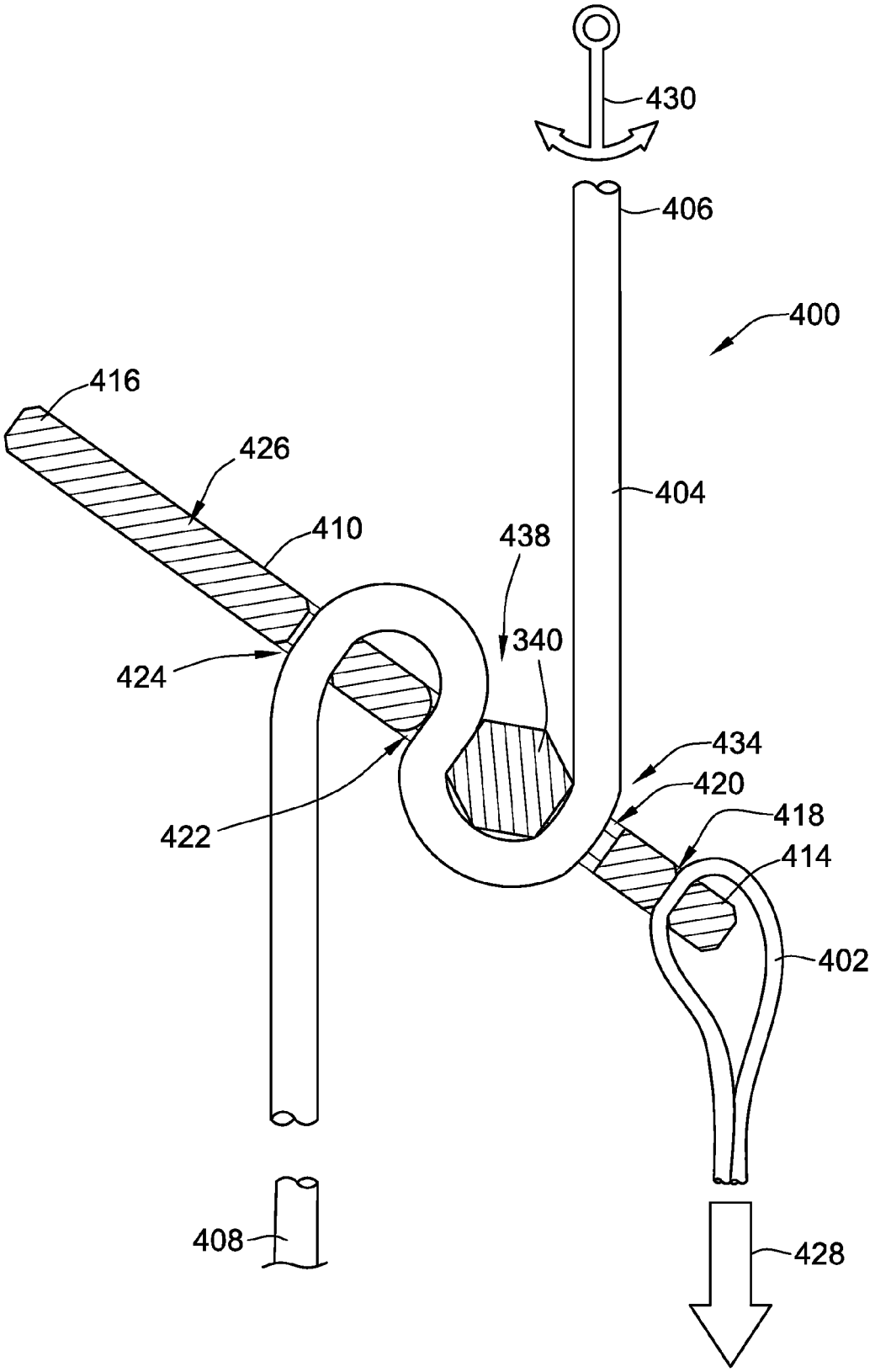
Figure 21:
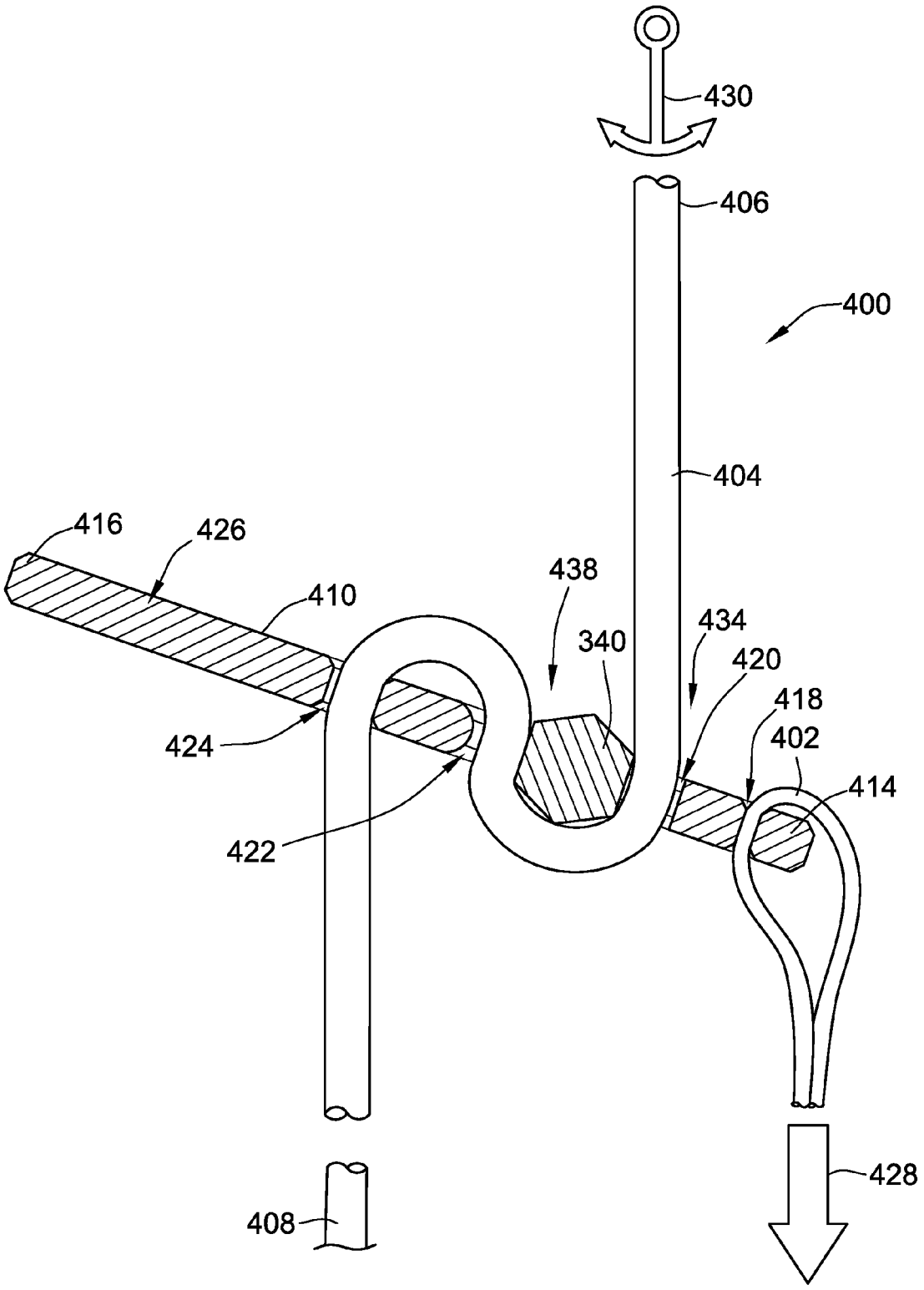
Figure 22:
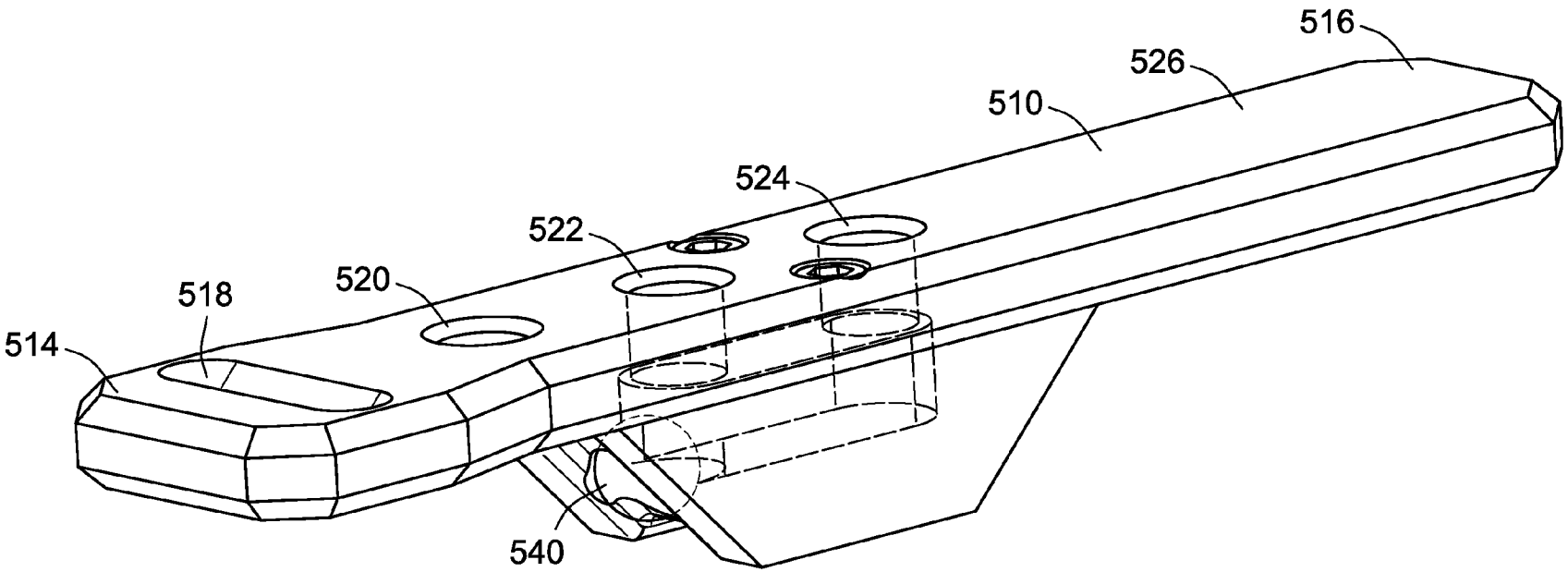
FIGS. 22-27 show a fifth exemplary embodiment of a rappelling apparatus, according to the invention, with FIGS. 26 and 27 showing the fifth exemplary embodiment in an un-actuated safety position and a descending position respectively. The fifth exemplary embodiment includes a one-way clutch arrangement having a moveable ball.
Figure 23:
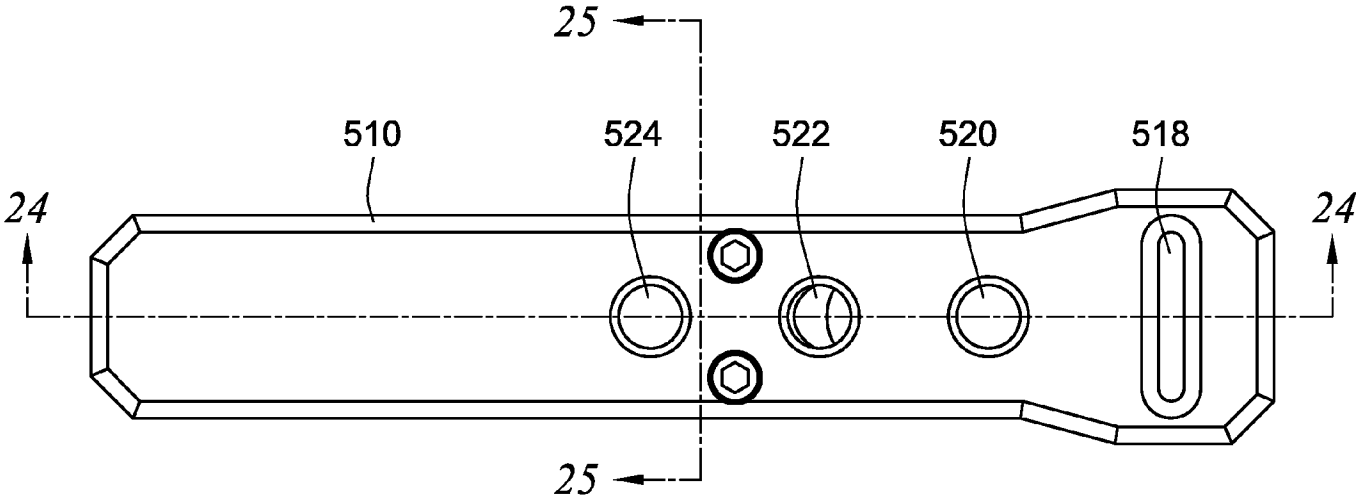
Figure 24:
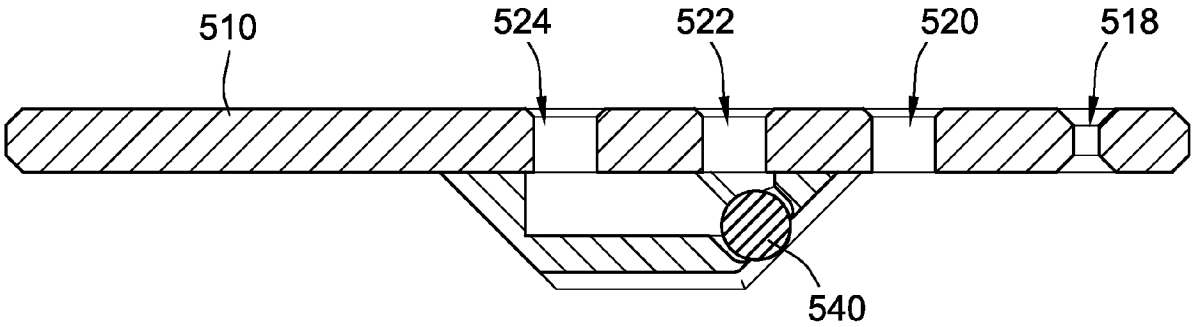
Figure 25:
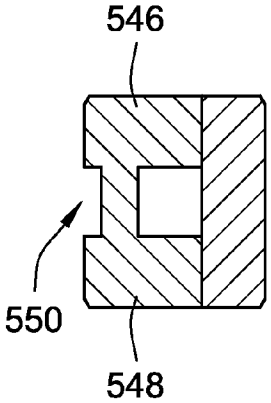
Figure 26:
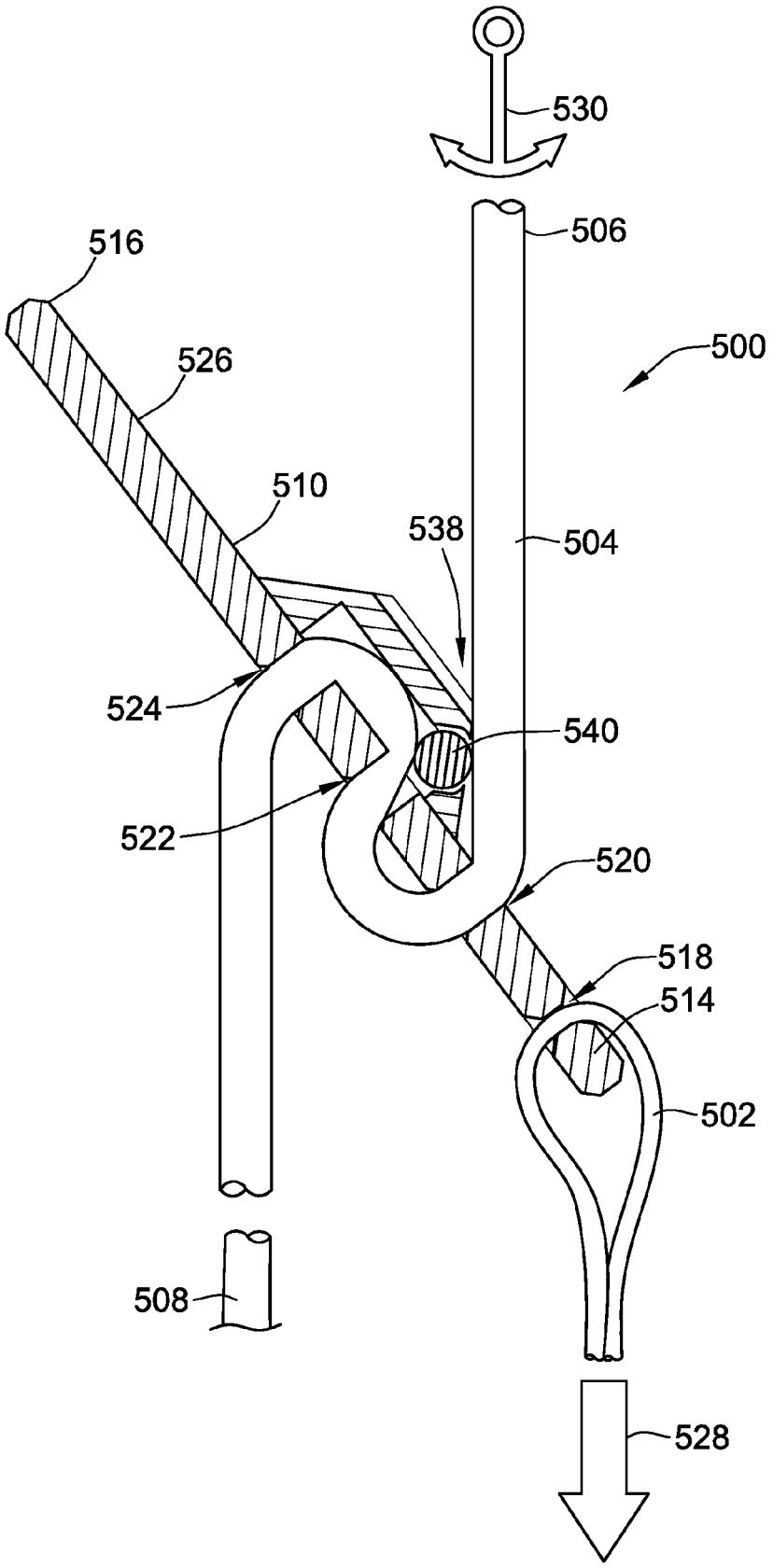
Figure 27:
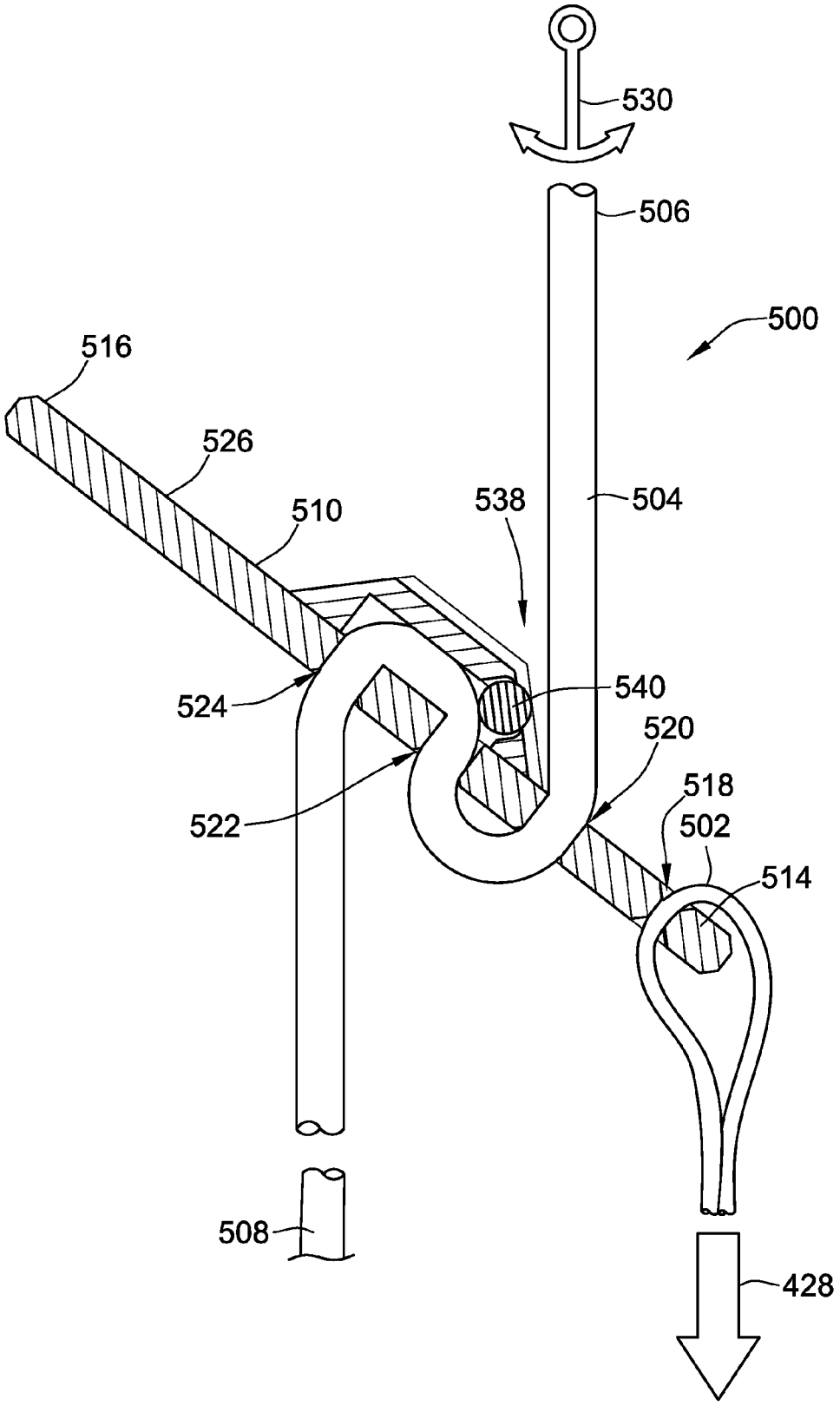
Figure 28:
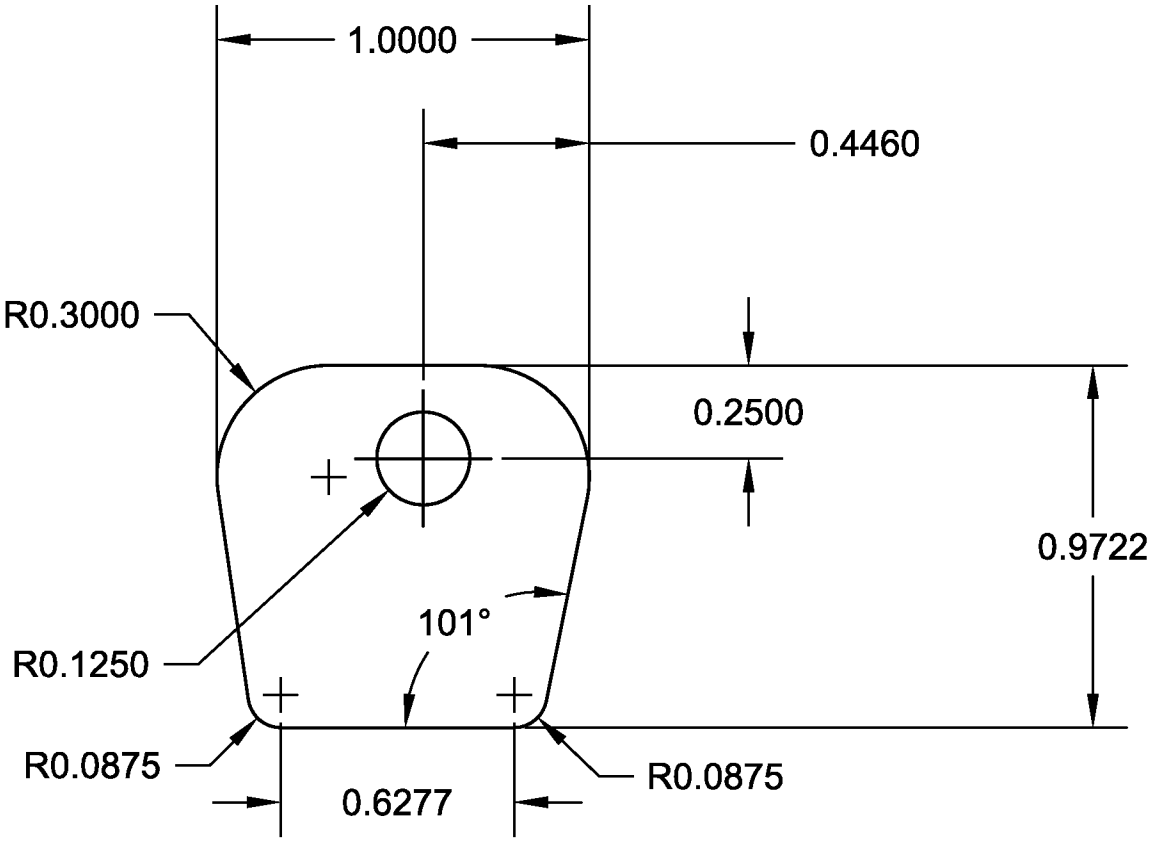
FIG. 28 is a dimensioned side view of one embodiment of a pivotable cam, according to the invention, for the embodiment shown in FIGS. 6-11.

As further shown in FIGS. 8-11 and 28, the pivotable cam 240 has an eccentrically shaped periphery 244 including rounded and straight segments shaped, spaced from the cam pivot axle 242 and interconnected in a manner which provides selectively more clamping force against the safety line 204 in a counter-clockwise rotational direction of the pivotable cam 240 as compared to pivoting motion of the cam 240 in the clockwise direction about the cam pivot axle 242 (with respect to the orientation of the control bar 210 as illustrated in FIGS. 8-11). Those having skill in the art will recognize that such a configuration selectively biases clamping force of the cam 240 in a manner which tends to increase locking force of the cam in the safety position, as shown in FIG. 10 and facilitates unlocking of the cam 240 when the control handle 226 is moved away from the safety position in the manner shown in FIG. 11. Those skilled in the art will also recognize that the invention may be practiced in forms having a cam 24 with dimensions or shapes different from the shape and dimensions shown in FIG. 28.

As shown in FIGS. 8-11, the second exemplary embodiment of the control bar 210 also includes a pair of ears 246, 248 configured to extend along opposite faces of the eccentrically mounted pivotable cam 240. As best seen in FIGS. 8 and 9, the ears 246, 248 extend away from the pivot axle 242 a greater distance than the periphery 244 of the cam 240, to thereby form a groove 250 between the ears 246, 248 to help guide the safety line 204 along the periphery 244 of the cam 240 and through the first through-hole 220.

From FIGS. 6-11, it will be understood that, in the second exemplary embodiment of the control bar 210, the first and second through-holes 220, 222 are defined by spaces formed between the periphery 244 of the pivotable cam 240 and the body of the control bar 210.

As further illustrated in FIGS. 6, 8, 10 and 11, the second exemplary embodiment of the control bar 210 also includes a cross pin 252, which performs a dual function of providing a wear-resistant surface at the point of greatest clamping force of the safety line 204 against the periphery of the second through-hole 222, and also creates a protrusion extending partly into the second through-hole 222 to thereby enhance resistance and/or the clamping effect generated on the safety line 204 during operation of the rappelling apparatus 200.

Generally, in practicing the invention, it is desirable to produce a control bar from light-weight materials to reduce the effort required to carry a rappelling apparatus according to the invention, in a firefighter's bail-out system, for example. In the second exemplary embodiment of the rappelling apparatus shown in FIGS. 6-11, for example, it may be desirable to fabricate the body of the control bar 210 from a light-weight material such as aluminum or polymer, and fabricate the pivotable cam, the cam axle 240, the cam axle 242 and the cross pin 252 from another material which is more wear resistant, such as stainless steel or ceramic.

It will be understood, in practicing the invention, that in other embodiments a wear resistant and/or resistance increasing element may take any appropriate form and be considerably different from the cross pin 252 of the exemplary embodiment 210, within the scope of the invention.

Those having skill in the art will recognize that the addition of a one-way clutch arrangement in a rappelling apparatus and/or method according to the invention provides a number of advantages. Among these advantages are the ability to provide enhanced control of motion of the safety line 204 through the control bar 210. Also, such one-way clutch arrangements may provide enhanced reliability and an increased capability to custom-fit a rappelling apparatus according to the invention to the weight and equipment load to be carried by a specific user of such an apparatus or method according to the invention.

Those having skill in the art will recognize that a rappelling apparatus and/or method according to the invention may use a variety of other one-way clutch arrangements having configurations quite different from the eccentrically mounted cam described hereinabove with regard to FIGS. 6-11. For example, in a third exemplary embodiment of a rappelling apparatus 300 shown in FIGS. 12-16, a one-way clutch arrangement 338 utilizes an eccentrically mounted cam 340 having a periphery 344 of different shape than the cam 240 of the second exemplary embodiment. Specifically, the cam 340 of the third exemplary embodiment has a substantially circular periphery 344 including a number of facets 345. Construction and operation of the third exemplary embodiment 300 of the invention is otherwise similar to the construction and operation of the second exemplary embodiment of the rappelling apparatus 200 describe hereinabove.

FIGS. 17-21 illustrate a fourth exemplary embodiment of a rappelling apparatus 400, according to the invention, which utilizes a sliding cam 440 in a one-way clutching arrangement 438, rather than the pivoting of cam clutch arrangements 238, 338 described hereinabove with regard to the second and third exemplary embodiments of a rappelling apparatus 200, 300.

The sliding one-way clutch arrangement 438 utilizes a sliding cam 240 mounted on a pair of rails or bars 441, 443 to create the first and second through-holes 420, 422 in combination with the body of the control bar 410. The periphery 444 of the sliding cam 440 includes six faceted faces.

FIGS. 22-27 show a fifth exemplary embodiment of a rappelling apparatus 500, according to the invention, in which a one-way clutching arrangement 538 utilizes a moveable ball 540 for controlling resistance to passage of the safety line 504 through the control bar 510.

FIGS. 29-36 show a sixth exemplary embodiment of a rappelling apparatus 600, according to the invention. The six exemplary embodiment of the rappelling apparatus 600 is similar in many respects to the second and third exemplary embodiments of rappelling apparatuses 200, 300 described above, in that the sixth exemplary embodiment of the rappelling apparatus 600 also uses a one-way clutching arrangement 638 having an eccentrically mounted cam 640 with an irregularly shaped, faceted periphery as the primary means of controlling resistance to passage of the safety line 604 through the control bar 610. For the sake of clarity of explanation, and avoiding unnecessary repetition, the components and elements of the sixth exemplary embodiment of the rappelling apparatus 600 follow the same numbering convention for reference numerals utilized in the description above of the second and third exemplary embodiments of the rappelling apparatuses 200, 300. Specifically, a component or element of the sixth exemplary embodiment 600 having a reference numeral 6XX will correspond to a similar previously described component or element 2XX or 3XX for the second and third exemplary embodiments 200, 300.

As will be understood from an examination of FIGS. 29-34 and the description below, the sixth exemplary embodiment of the rappelling apparatus 600 differs from the second and third exemplary embodiments 200, 300 primarily by virtue of the sixth exemplary embodiment of the rappelling apparatus 600 further including a braking arrangement 679 operatively incorporated into the operating handle portion 626 of the control bar 610.

Figure 35:
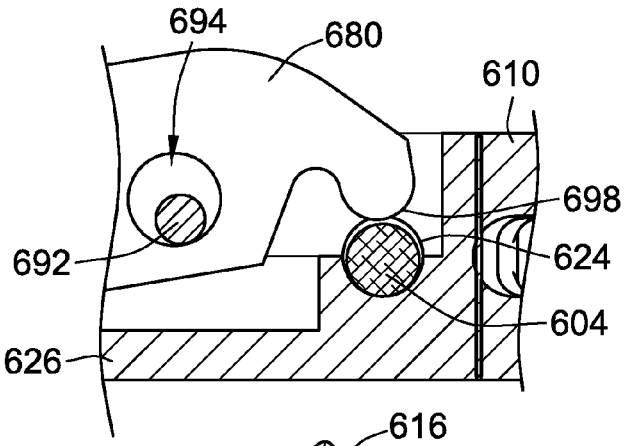
Figure 36:
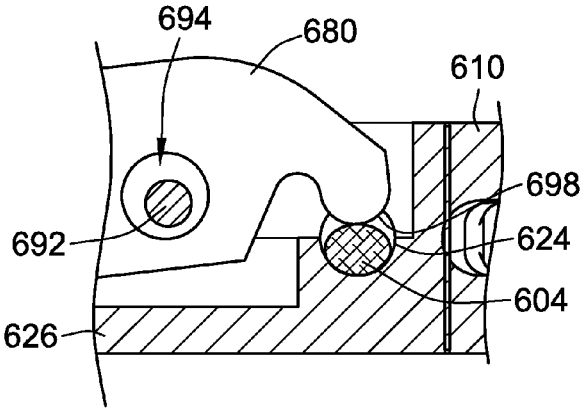
Figure 34:
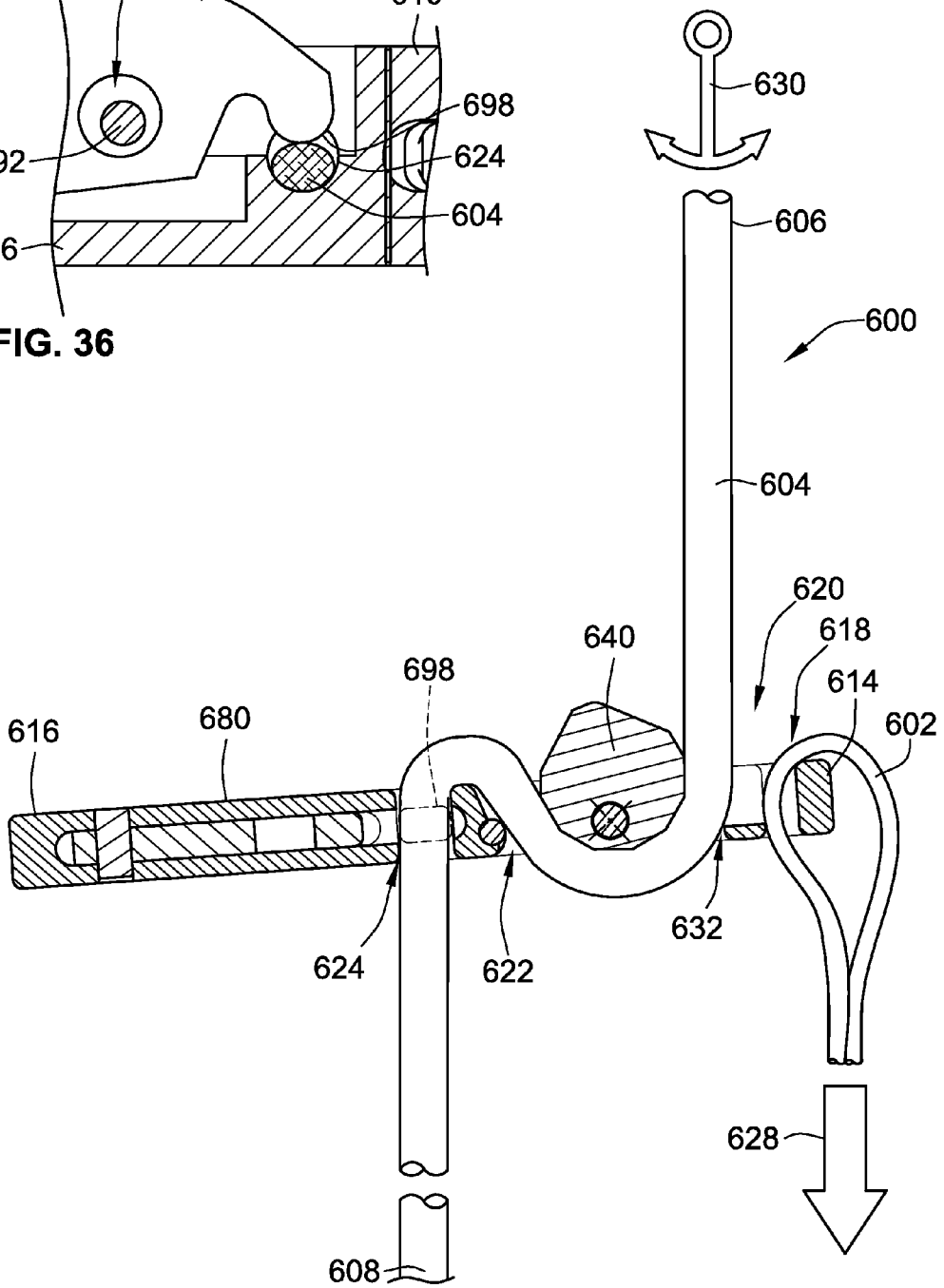

As described in more detail below, the braking arrangement 679 includes a pivotably mounted braking lever 680 which is operatively mounted for selective movement from a non-braking position shown in FIG. 35 in which the safety line 604 is free to pass through the third through-hole 624 in the control bar 610, and a full-braking position as shown in FIG. 36 in which a braking surface 698 adjacent a distal end 684 of the braking lever 680 compresses the safety line 604 against the wall of the third through-hole 624 to provide additional resistance to the passage of the safety line 604 through the third through-hole 624.

Figure 29:
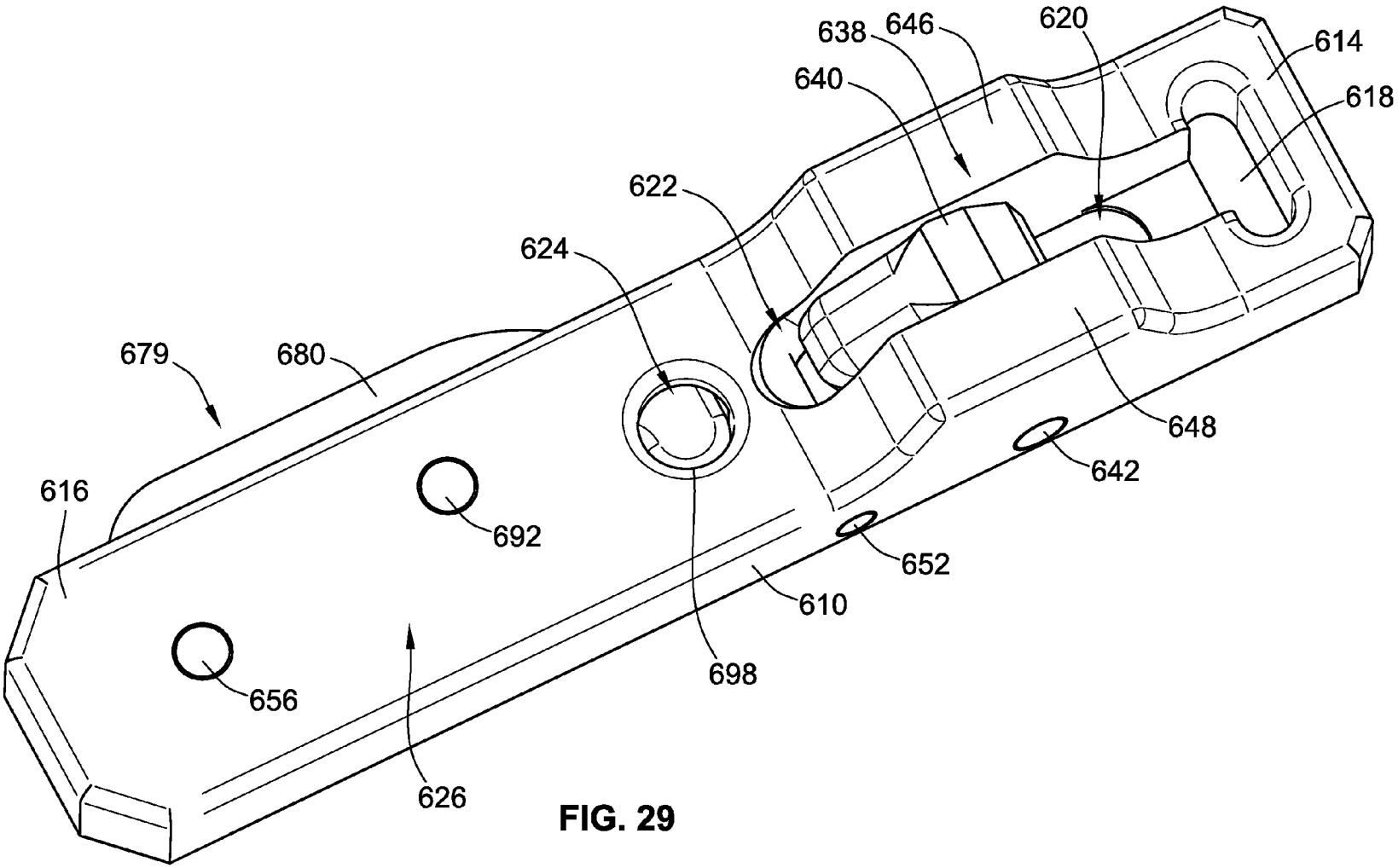
FIGS. 29-36 show a sixth exemplary embodiment of a rappelling apparatus, according to the invention, with FIGS. 33 and 34 showing the sixth exemplary embodiment in an un-actuated safety position and a descending position respectively. The sixth exemplary embodiment includes a one-way clutch having an eccentrically mounted pivotable cam, and also includes a hand-operable braking arrangement.
Figure 30:
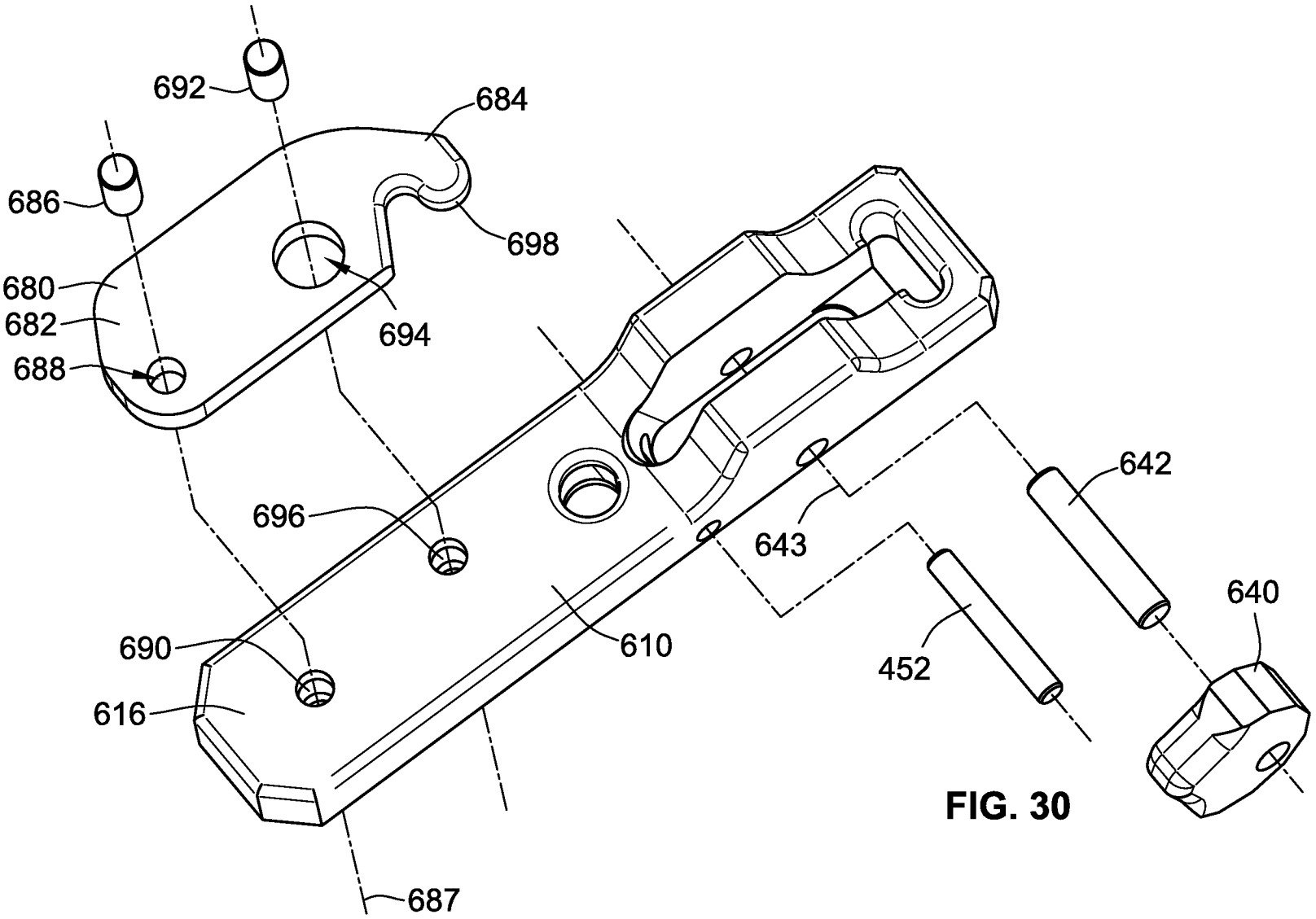
Figure 31:
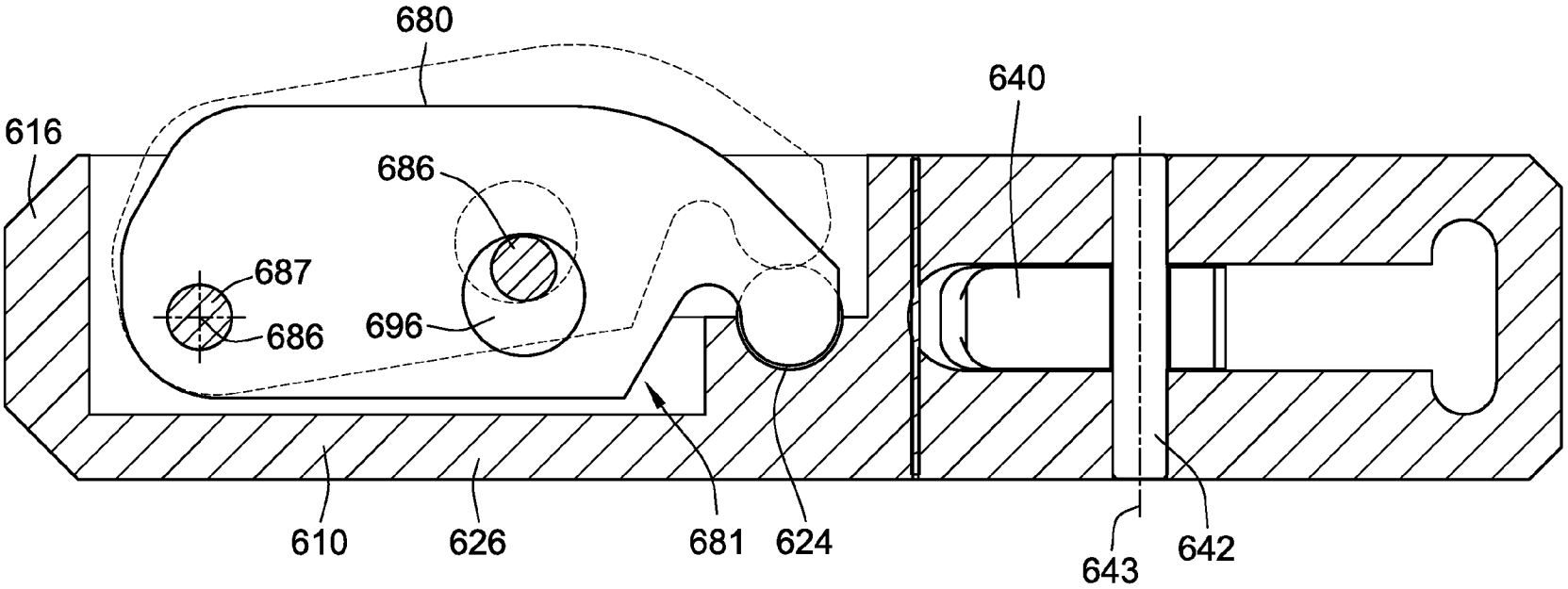

As shown in FIGS. 29-31, the braking lever 680 is pivotably mounted inside of a slot 681 located within the operating handle portion 626 of the body of the control bar 610 in such a manner that a hand grasping the operating handle 626 of the control bar 610 can also selectively move the braking lever 680 between the no-braking and the full-braking position, while simultaneously moving the operating handle 626 toward and away from the safety position.

In similar fashion to the cams 240, 340 in the first and second exemplary embodiments of the rappelling apparatuses 200, 300, the pivotable cam 640 of the sixth exemplary embodiment 600 is eccentrically mounted on the control bar 610 for pivotable movement about a cam pivot axis 643 extending substantially parallel to the width of the control bar 610. The proximal end 682 of the braking lever 680 is pivotably attached to the control bar 610, at a point adjacent to the distal end 616 of the control bar 610, by a braking lever pivot pin 686 for pivoting motion about a braking lever pivot axis 687 extending substantially perpendicular to the cam pivot axis 643. The braking arrangement 679 further includes a braking lever travel limiting arrangement, in the form of a travel limiting pin 692 and a clearance hole 694 in the braking lever 680, which cooperatively constrain the braking lever 680 for movement between the no-braking position shown in FIG. 35 and the full-braking position shown in FIG. 36. Specifically, the travel limiting pin 692 extends through the travel-limiting hole 694 in the braking lever 680 and into fixed engagement with a travel limiting pin through-hole 696 in the control bar 610, for limiting movement of the braking lever 680 in the manner best illustrated in FIG. 31.

Figure 33:
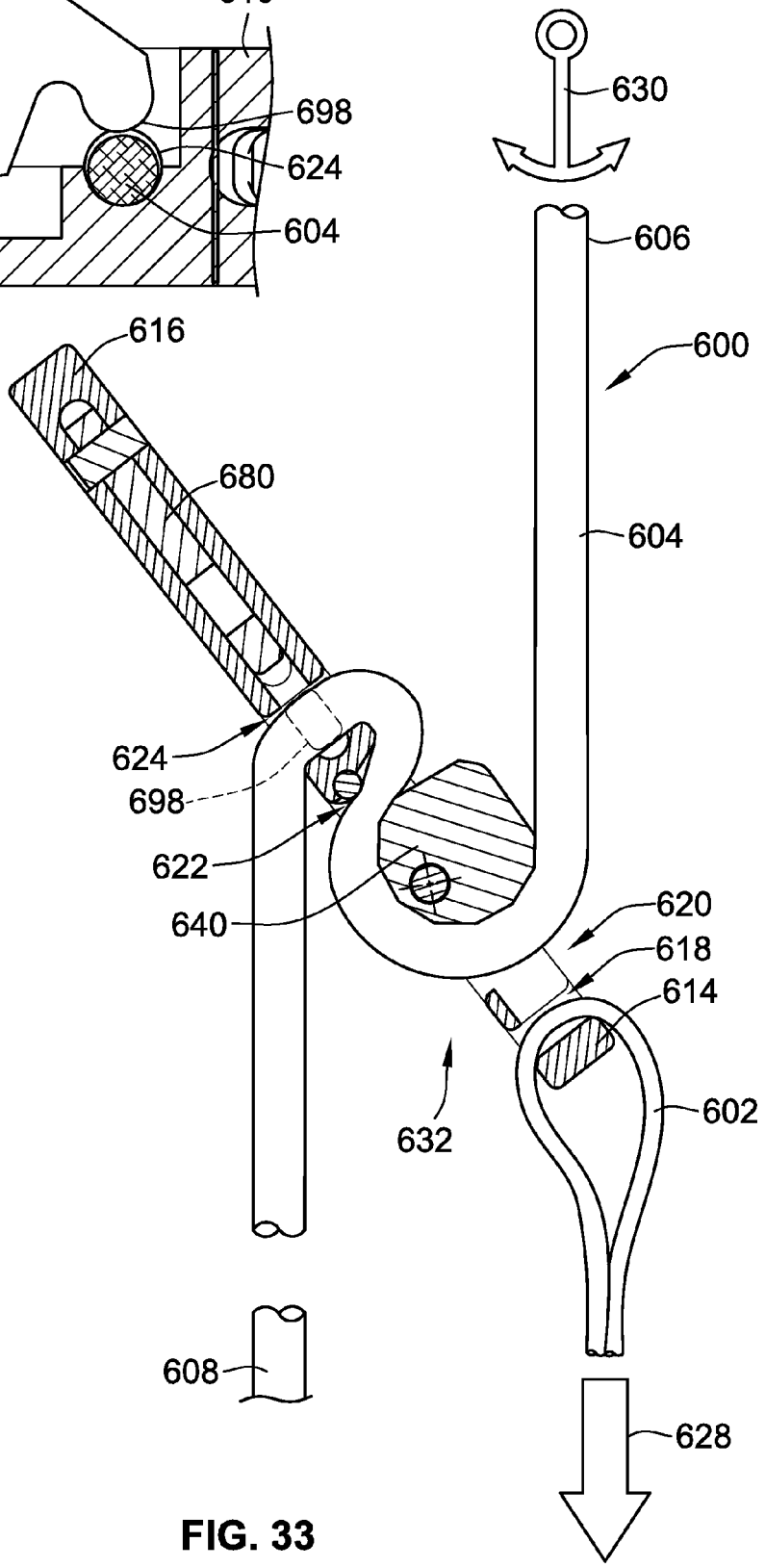

It will be appreciated, by those having skill in the art, that the configuration and arrangement of the braking lever 680 in coordination with the operating handle 626 of the control bar 610 is ergonomically selected to allow a person utilizing the rappelling apparatus 600 to control both movement of the control bar 610 toward and away from the safety position of the control bar shown in FIG. 33 while simultaneously controlling the amount of additional braking force applied by the braking lever 680 to the safety line 604 with one hand. In addition to providing enhanced control of the resistance applied to the safety line 104 and as a result the speed of descent of the person using the rappelling apparatus 600.

Having the braking arrangement 679 of the rappelling apparatus 600 be configured in such a manner that a hand grasping the operating handle 626 of the control bar 610 will also inherently wrap around the braking lever 680 provides an additional advantage, if the person utilizing the rappelling apparatus 600 should inadvertently move the control bar 610 too far from the safety position. In such a situation, which may result in a higher than desired rate of descent, a reflex reaction of the person operating the rappelling apparatus 600 will likely cause the hand gripping the operating handle 626 of the control bar to squeeze more tightly on the operating handle 626 and thereby increase the secondary braking force on the safety line 604 applied by the braking lever 680 to slow the speed of decent to a more desirable rate.

Figure 32:
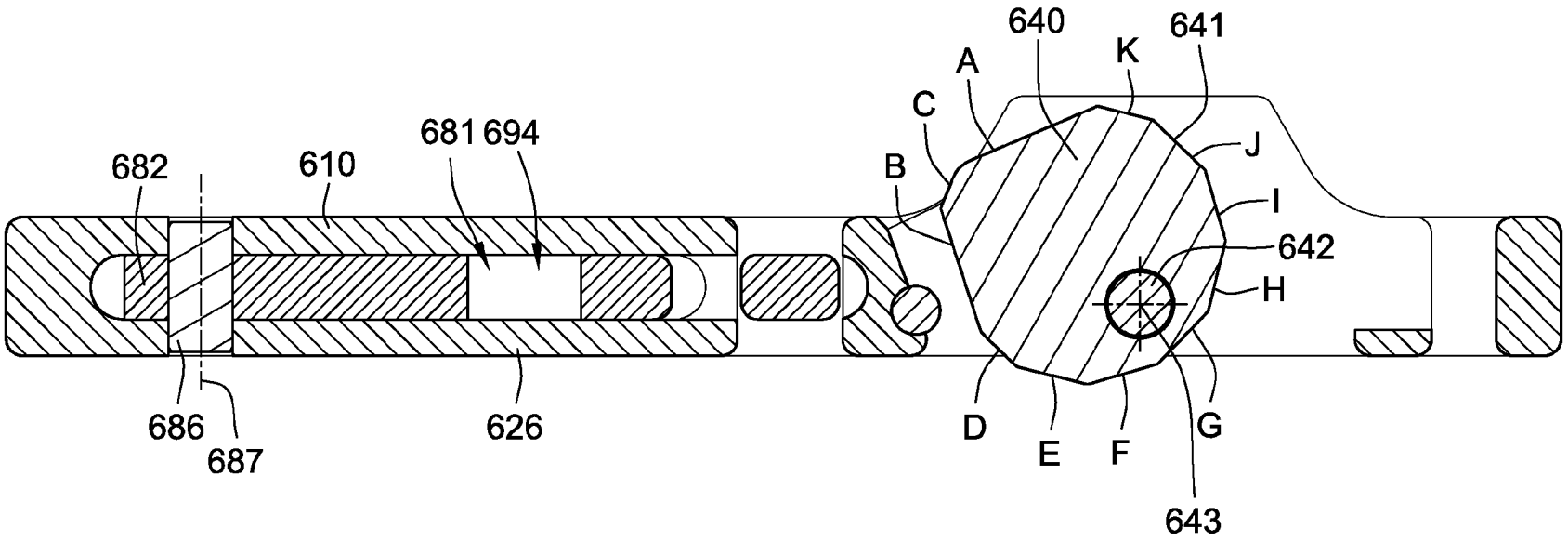

As shown in FIG. 32, the cam 640 has a cross-sectional shape similar to a baseball diamond with a closed periphery 641 thereof defined by a series of substantially straight facets including a pair of first and second long facets A, B joined at one end thereof by a short facet C having a length substantially less than either of the first and second long facets A, B. The long facets A, B angle away from one another from their respective first ends toward their respective second ends. The second ends of the long facets A, B are joined to one another by a plurality of intermediate length facets D-K having lengths greater than the short facet C but less than the long facet A, B. The intermediate facets D-K are joined sequentially to one another to form a curved convex shape bowing outward from the short facet C and joined at opposite ends of the curved convex shape to the second ends of the first and second long facets A, B. The cam pivot axis 643 extends through the cam cross-section within the cross-section at a point offset from a geometric center of the cam 640.

It will be observed that the arrangement of facets A, L described above forms the "baseball-diamond-like" closed periphery of the cam with the short facet C being representative of home plate on a baseball diamond, long facets A, B representing the third and first base lines, and the facets D-K representing the outfield fence of the baseball diamond. The cam pivot axis 643 in the cam 640 is located in what would be essentially right-center field of the baseball-diamond-shaped cam, with the cam 640 oriented in the manner shown in FIG. 32. It will be further noted, with reference to FIGS. 29 and 30, that the outer profile of the cam 640 is rounded in some areas in addition to being faceted. Those having skill in the art will recognize that the invention may be practiced in other embodiments with cam configurations having different profiles and mounting arrangements.

FIGS. 37-41 show a seventh exemplary embodiment of a rappelling apparatus 700, according to the invention. The seventh exemplary embodiment of the rappelling apparatus 700 is similar in many respects to the second and third exemplary embodiments 200, 300 described above, and particularly similar to the sixth exemplary embodiment 600, because the seventh exemplary embodiment 700 also includes a braking arrangement 779. As was the case with components and elements in the sixth exemplary embodiment 600, the components and elements of the seventh exemplary embodiment 700 have reference numerals 7XX which correspond to similar previously described components or elements 2XX, 3XX or 6XX for the second, third and sixth exemplary embodiments 200, 300, 600.

In general, the seventh exemplary embodiment of the rappelling apparatus 700 is constructed and operates in substantially the same way as the previously described sixth exemplary embodiment of the rappelling apparatus 600. The seventh exemplary embodiment 700 is configured to accommodate a larger safety line 704 than the sixth exemplary embodiment 600, but the various features of the seventh exemplary embodiment 700 may also have utility in other embodiments of the invention not having larger safety lines.

Figure 37:
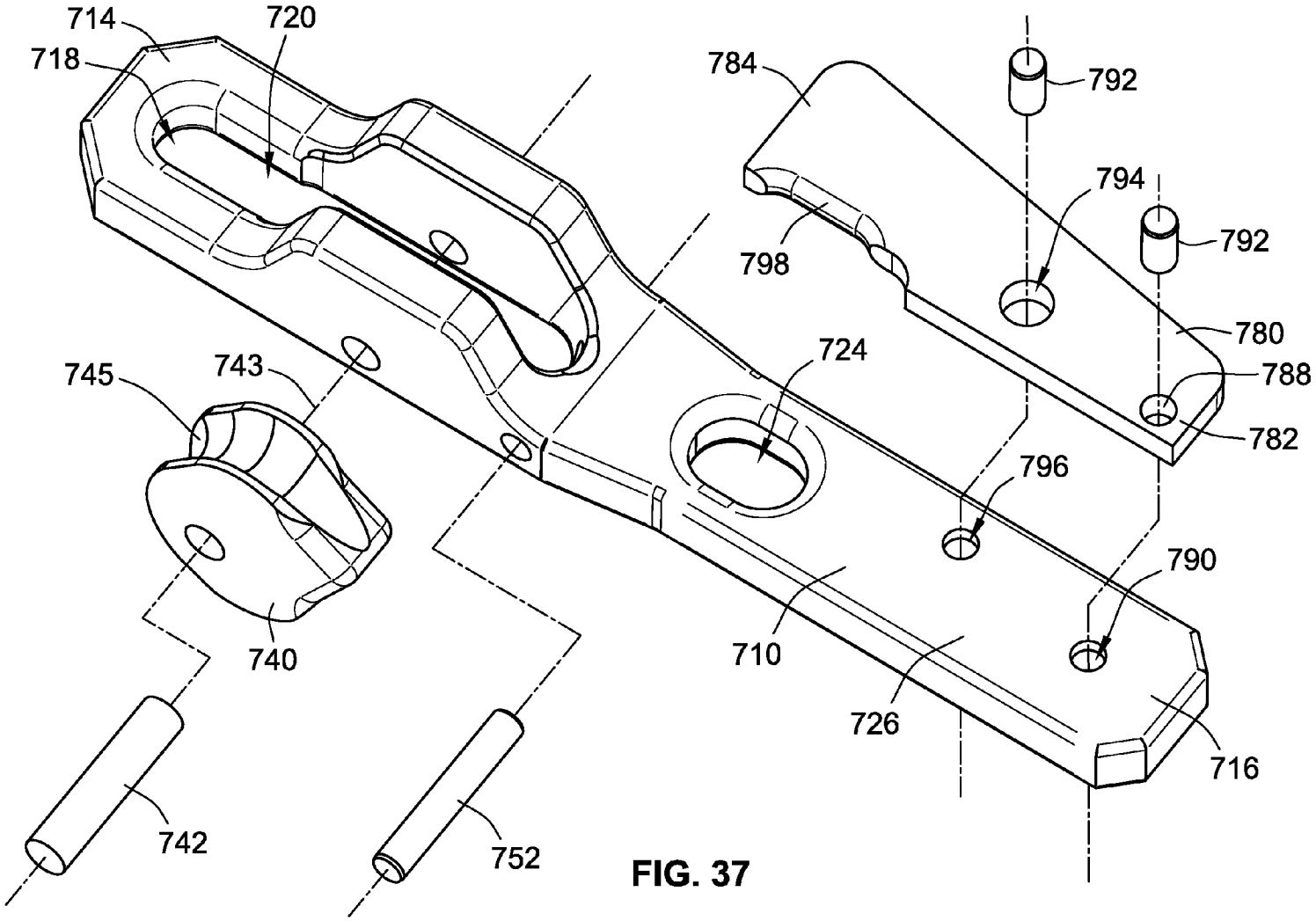
FIGS. 37-41 show a seventh exemplary embodiment of a rappelling apparatus, according to the invention, with FIGS. 40 and 41 showing the seventh exemplary embodiment in an un-actuated safety position and a descending position respectively. The seventh exemplary embodiment includes a one-way clutch having an eccentrically mounted pivotable cam, and also includes a hand-operable braking arrangement.
Figure 38:
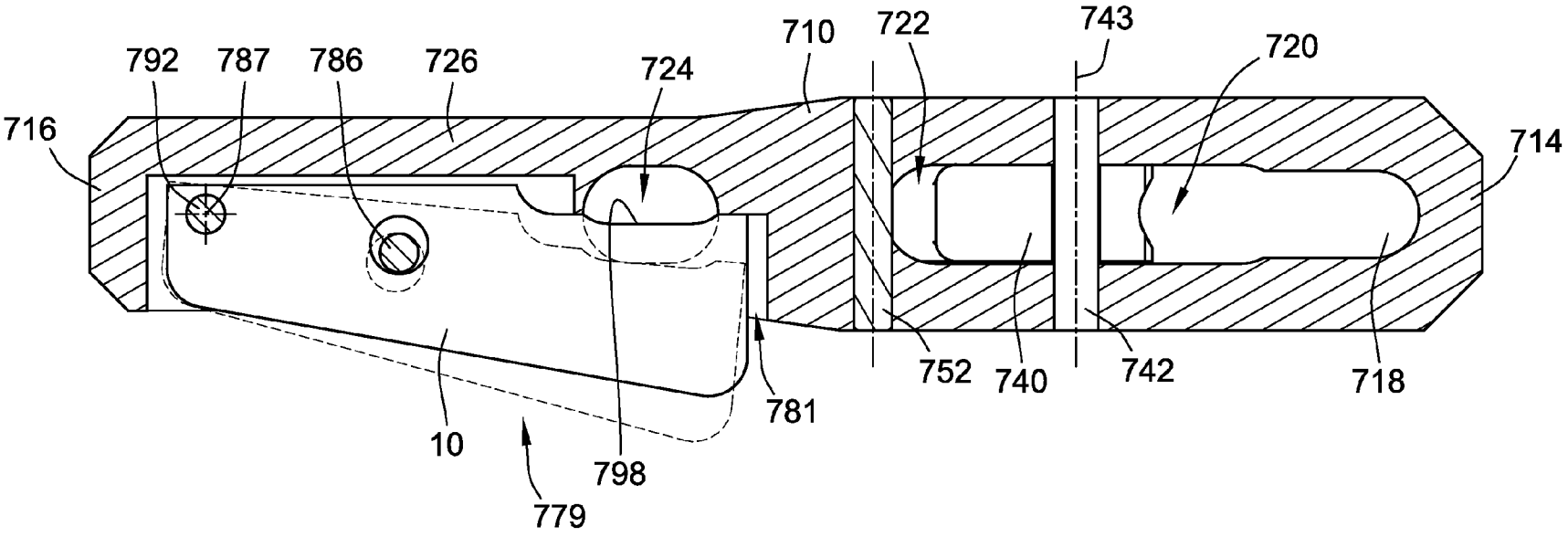

As shown in FIGS. 37 and 38, the braking surface 798 of the braking surface 798 of the braking lever 780 has a different configuration than the braking surface 698 of the braking lever 680 in the sixth exemplary embodiment, to provide a larger bearing surface for compressing the safety line 704 against a side of the third through hole 724. The third through hole 724 is also somewhat elongated in shape to accommodate more room for compression of the safety line 704 by the braking surface 798 when the braking lever 780 is applying braking force.

Figure 39:
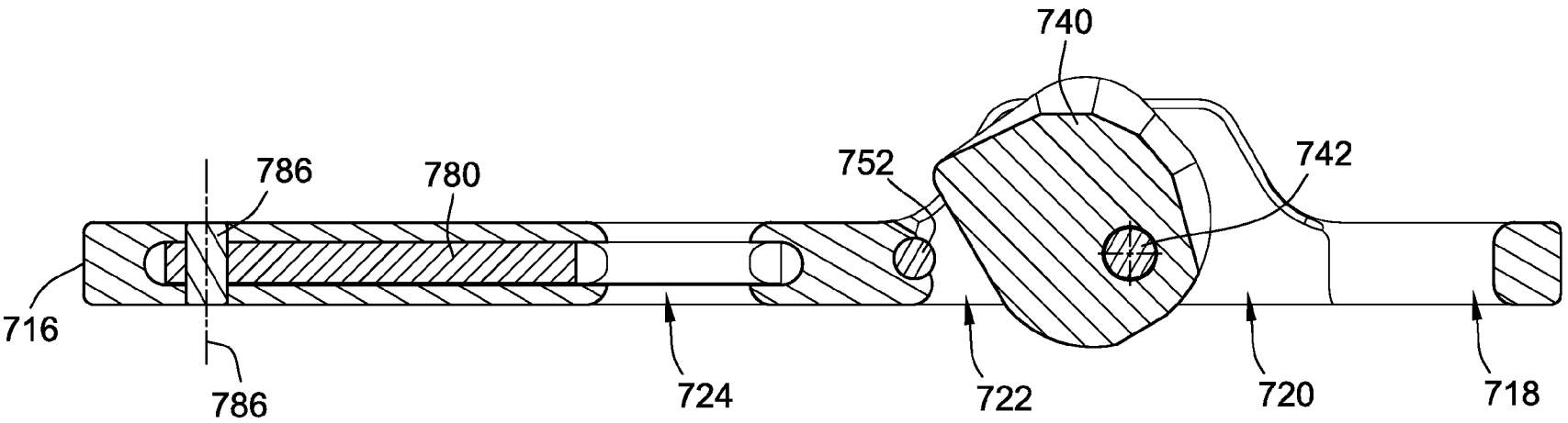
Figure 40:
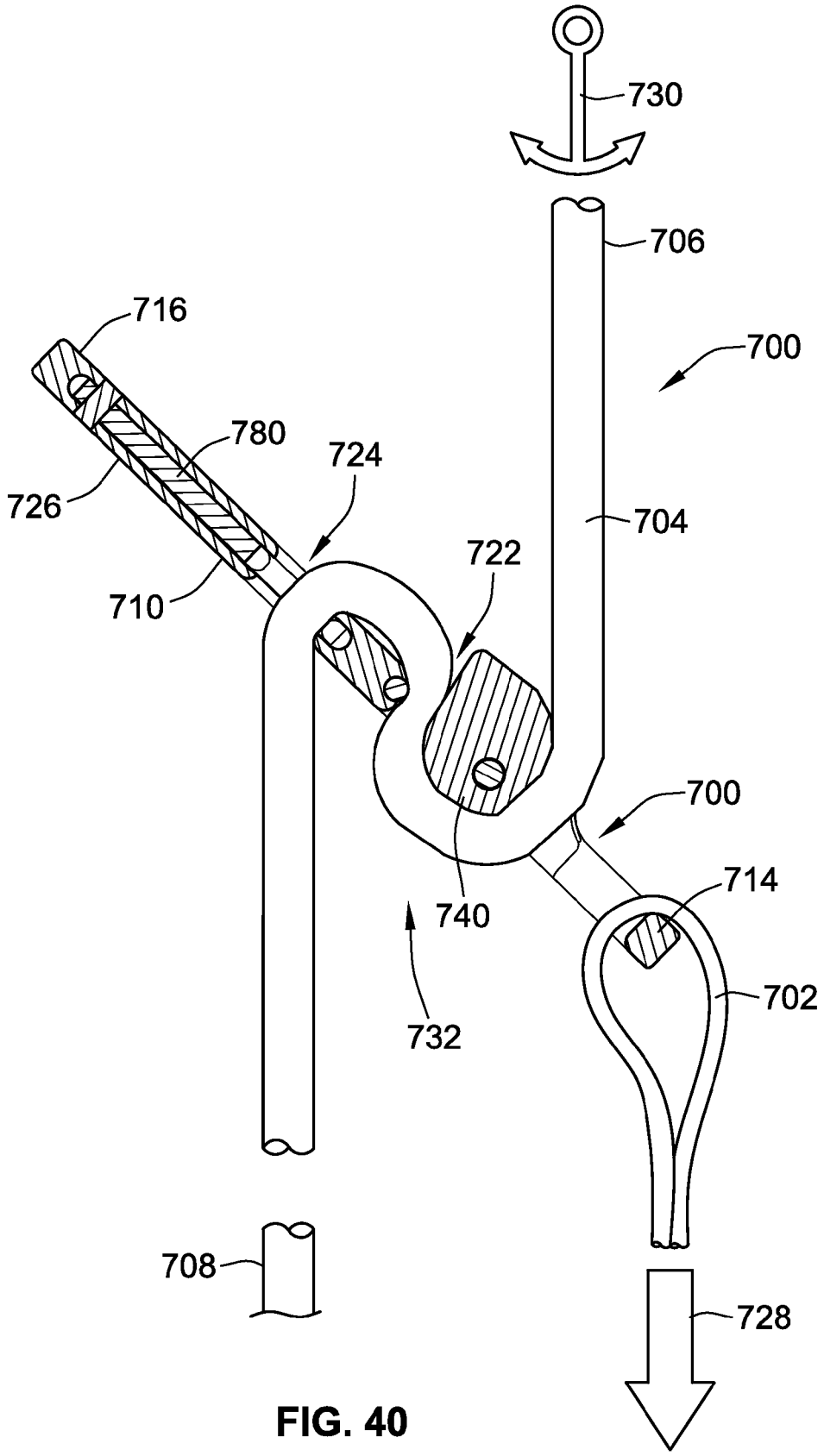

As shown in FIGS. 37 and 39, the cam 740 in the seventh exemplary embodiment of the rappelling apparatus 700 has a periphery including a number of various sized facets, in similar fashion to the cam 640 of the sixth exemplary embodiment 600. In the cam 740, however, a portion of the outer periphery of the cam forms a concave groove extending across one or more of the facets of the cam. The inclusion of such a groove increases the surface area of the working portion of the cam periphery to thereby increase friction and clamping force exerted by the cam 740 on the safety line 704 during operation of the seventh exemplary embodiment of the rappelling apparatus 700.

As shown in FIGS. 37 and 38, in the seventh exemplary embodiment of the rappelling apparatus 700 the first and fourth through holes 720, 718 extend into one another to provide a larger elongated opening for passage both the safety line 704 and for attachment of the safety harness 702.

Figure 42:
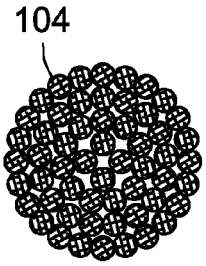
FIGS. 42-44 are cross-sectional illustrations of several types of safety line configurations which may be used in practicing the invention.
Figure 43:
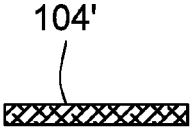
Figure 44:
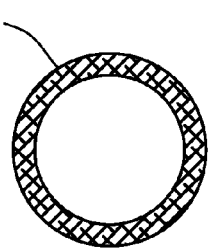
Figure 41:
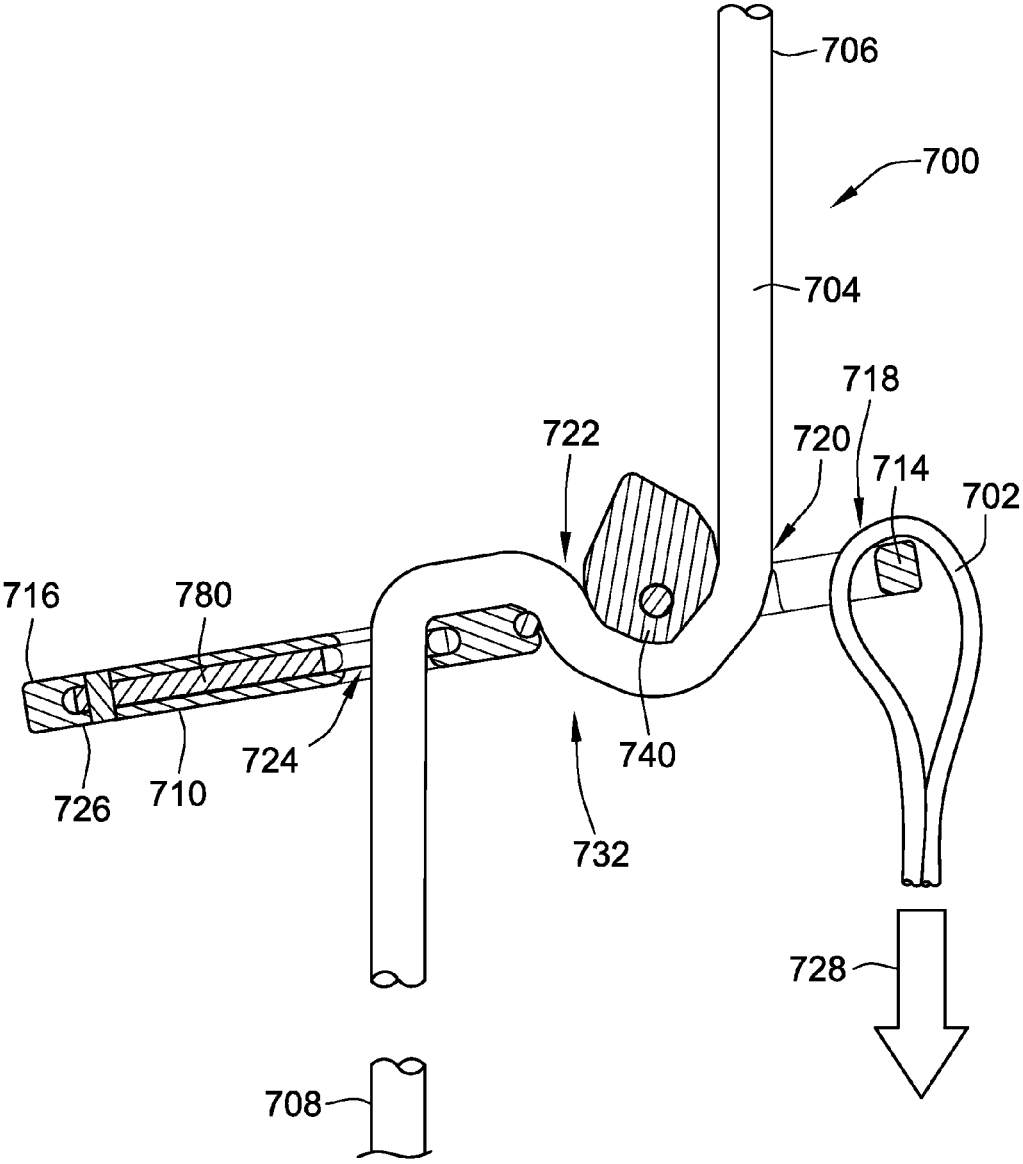

It will be understood, by those having skill in the art, that a safety line for use with the present invention can take a variety of appropriate shapes. For example, the safety line may be substantially circular in cross section as shown in FIG. 42, a flat web as shown in FIG. 43, a hollow web as shown in FIG. 44, or any other appropriate shape.

For each of the exemplary embodiments of rappelling apparatuses 200, 300, 400, 500, 600, 700 having a one-way clutching arrangement 238, 338, 438, 538, 638, 735 it will be recognized that the configurations described hereinabove result in a portion of the safety line 204, 304, 404, 504, 604, 704 extending between the first though hole 320, 420, 520, 620, 720 and the anchor 230, 330, 430, 530, 630, 730 bearing against the moveable element 240, 340, 440, 540, 640, 740 of the respective one-way clutching arrangement 238, 338, 438, 538, 638, 738 in a manner in which substantially enhances clamping action of the control bar 210, 310, 410, 510, 610, 710 against the safety line 204, 304, 404, 504, 604, 704 particularly in the safety positions shown in FIGS. 10, 15, 20, 26, 33 and 40.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A rappelling apparatus for controlling a descent of a person wearing a harness attached along a safety line anchored at a proximal end of the safety line and having a length of the safety line extending vertically away from the proximal end and terminating in a distal end of the safety line, the rappelling apparatus comprising:

a control bar having a body defining a fixed major length of the control bar extending along a major longitudinal axis of the control bar between first and second ends of the control bar;

the body of the control bar also defining a width of the control bar extending substantially orthogonally to the longitudinal axis, and the body defining a thickness of the control bar extending substantially orthogonally to both of the longitudinal axis and the width of the control bar;

the first end of the control bar having an aperture passing through the thickness of the control bar for attachment thereto of the harness;

the body of the control bar defining first, second and third through holes extending through the thickness of the body of the control bar, with the through holes being sequentially aligned along the longitudinal axis with the first through hole being disposed closer to the first end of the control bar than the second and third through holes, the third through hole being disposed farther from the first end of the control bar than the first and second through holes, and the second through hole being disposed between the first and third through holes;

the through holes sequentially configured to allow the distal end and length of the safety line to slidingly and sequentially pass through the thickness of the control bar a first time through the first through hole, then back through the thickness of the control bar a second time through the second through hole, and then pass through and exit the thickness of the control bar a third time through the third through hole such that the safety line follows a substantially S-shaped path through the through holes;

a control bar pivot axle extending across the width of the body of the control bar and disposed between the first through hole and the second through hole, wherein the control bar pivot axle is disposed closer to the first end of the control bar than to the second end of the control bar;

a cam eccentrically and pivotally mounted onto said axle, the cam configured to removably clamp the safety line against the control bar and configured to form the first and second through holes;

a portion of the body of the control bar extending between the third through hole and the second end of the control bar, the portion of the body forming an operating handle of the control bar for a hand of the person to grasp;

the operating handle is configured to be urged to rotate upwards toward a safety position while the cam is configured to be urged to pivot and clamp the safety line against the control bar when the safety line follows the S-shaped path and tension is applied to the safety line by a load of the person acting on the harness which acts onto the first end of the control bar, when in the safety position the second end of the control bar is pointing generally toward the proximal end of the safety line and the control bar and cam retard passage of the safety line through the through holes; and the operating handle is configured to be actively operated by the hand of the person directly pivoting the second end of the control bar away from the safety position, while the load is being applied to the first end of the control bar, to cause the safety line to pivot with respect to the axle against clamping to release pressure on the safety line through the through holes along the S-shaped path to cause the person to descend from a stopped position on the safety line.

2. The rappelling apparatus of claim 1, wherein, the safety line is locked against passage through the control bar when the operating handle is in the safety position thereof.

3. The rappelling apparatus of claim 2, wherein, said apparatus is configured to operably resist passage of the safety line through the control bar as the second end of the control bar is pivoted farther away from the safety position.

4. The rappelling apparatus of claim 1, wherein, the apparatus is configured to have a resistance to passage of the safety line through the control bar decrease as the second end of the control bar is pivoted farther away from the safety position.

5. The rappelling apparatus of claim 1, wherein, the cam comprises an outer surface including multiple facets for contacting the safety line.

6. The rappelling apparatus of claim 1, wherein, at least a portion of an outer surface of the cam is concave.

7. The rappelling apparatus of claim 1, further comprising a hand actuated brake arrangement operatively attached to the control bar for applying a braking force to the safety line as the safety line passes through the body of the control bar.

8. The rappelling apparatus of claim 7, wherein, the hand actuated brake arrangement includes a braking lever, wherein the braking lever is attached to the control bar and configured to allow the hand of the person to grasp the operating handle of the control bar and move the braking lever between a non-braking position and a full braking position while simultaneously moving the operating handle toward and away from the safety position.

* * * * *